US006698431B1

(12) United States Patent
Harris et al.

(10) Patent No.: US 6,698,431 B1
(45) Date of Patent: Mar. 2, 2004

(54) APPARATUS AND METHOD FOR SUPPORTING HUMAN BODY DURING ITIMATE ACTIVITY

(75) Inventors: Richard M. Harris, Cambridge, MA (US); David C. Rogers, Boston, MA (US); Sean Horita, Hilo, HI (US)

(73) Assignee: Compass Institute, Inc., Cambridge, MA (US)

( * ) Notice: Subject to any disclaimer, the term of this patent is extended or adjusted under 35 U.S.C. 154(b) by 153 days.

(21) Appl. No.: 09/648,639

(22) Filed: Aug. 25, 2000

Related U.S. Application Data

(60) Provisional application No. 60/151,898, filed on Sep. 1, 1999, and provisional application No. 60/183,574, filed on Feb. 18, 2000.

(51) Int. Cl.[7] ..... A61G 15/00

(52) U.S. Cl. ..... 128/845; 600/38; 297/325

(58) Field of Search ..... 128/845, 846; 600/38–41; 297/245, 246, 325

(56) References Cited

U.S. PATENT DOCUMENTS

| | | | | |
|---|---|---|---|---|
| 3,829,156 A | | 8/1974 | Iida | 297/216 |
| 4,099,773 A | | 7/1978 | Chang | 297/270 |
| 4,373,222 A | | 2/1983 | Wolfe | 5/431 |
| 4,538,856 A | | 9/1985 | Katsumoto | 297/367 |
| 4,699,423 A | | 10/1987 | Fitzig | 297/245 |
| 4,743,065 A | | 5/1988 | Meiller | 297/300 |
| 4,805,961 A | | 2/1989 | Garrod | 297/361 |
| 4,825,855 A | | 5/1989 | Kundson, Jr. | 128/79 |
| 4,863,219 A | | 9/1989 | Ochiai | 297/443 |
| 5,069,496 A | | 12/1991 | Kunh | 297/300 |
| 5,111,546 A | * | 5/1992 | Hahn | 14/71.3 |
| 5,125,884 A | | 6/1992 | Weber | 482/145 |
| 5,294,175 A | | 3/1994 | Elton | 297/216.1 |
| 5,350,346 A | | 9/1994 | Martinez | 482/142 |
| 5,385,154 A | | 1/1995 | Fuhrman | 128/845 |
| 5,389,062 A | | 2/1995 | Mitchum, Jr. | 600/38 |
| 5,443,532 A | | 8/1995 | Hudak | 5/652 |
| 5,453,080 A | | 9/1995 | Mitchum, Jr. | 600/38 |
| 5,538,011 A | | 7/1996 | Craft | 128/845 |
| 5,543,532 A | | 8/1996 | Kourtakis | 549/260 |
| 5,586,560 A | | 12/1996 | Boutos | 128/845 |
| 5,636,898 A | | 6/1997 | Dixon | 297/316 |
| 5,782,243 A | | 7/1998 | Bisyak | 128/845 |
| 5,875,779 A | | 3/1999 | Fuhrman | 128/845 |
| 6,022,076 A | | 2/2000 | Samson | 297/281 |

FOREIGN PATENT DOCUMENTS

| | | |
|---|---|---|
| JP | 8-10078 | 1/1996 |

* cited by examiner

*Primary Examiner*—Michael A. Brown
(74) *Attorney, Agent, or Firm*—Ivan D. Zitkovsky

(57) ABSTRACT

The present invention relates to apparatuses and methods for supporting a human body during intimate activities. The apparatuses include a base connected to an adjustable frame and one or more support surfaces for at least partially supporting the human body. The frame includes a main rail connectable to one or more rails arranged to bear weight of the support surfaces and constructed to displace the support surfaces to selected positions.

37 Claims, 18 Drawing Sheets

APPARATUS AND METHOD FOR SUPPORTING HUMAN BODY DURING ITIMATE ACTIVITY

This application claims priority from U.S. Provisional Application Serial No. 60/151,898 filed on Sep. 1, 1999, and U.S. Provisional Application Serial No. 60/183,574 filed on Feb. 18, 2000, both of which are incorporated by reference.

FIELD OF INVENTION

The present invention relates to apparatuses and methods for supporting a human body preferably during an intimate activity.

BACKGROUND OF INVENTION

According to a study published in The Journal of American Medical Association, about 43 percent of woman and 31 percent of men regularly experience sexual dysfunction (JAMA, Feb. 10, 1999). The reported sexual dysfunctions include lack of interest in sex, problems with arousal, problems related to climaxing and ejaculation, pain during intercourse, not enjoying sex, and anxiety about sexual performance.

Sexual dysfunctions can be classified as life long, acquired, and situational. Life long sexual dysfunctions have always been present. Acquired sexual dysfunctions start due to physical or emotional problems at some point in the life of a person, who was able to function previously without the dysfunction. Situational sexual dysfunctions occur in some situations, but do not occur in other situations. Sexual dysfunction may also arise from ignorance or misinformation, due to poor communication or deterioration of a relationship, due to organic causes, or due to psychiatric illnesses.

There are different types of sexual disorders in both females and males. The American Psychiatric Association in their recent edition of the Diagnostic and Statistical Manual (DSM-IV, 4th ed., Brandon/Hill, 1994) defined and classified at least the following sexual disorders in females and males: Female Sexual Arousal Disorder, Female Orgasmic Disorder, Vaginismus, Erectile Dysfunction, Male Orgasmic Disorder, and Premature Ejaculation.

Female Sexual Arousal Disorder is defined by the Diagnostic and Statistical Manual as a persistent or recurrent inability to attain or maintain arousal until completion of sexual activity. It is the inhibition or lack of general arousal and may include abnormal lubrication and swelling response. The woman with Female Sexual Arousal disorder does not adequately lubricate, her vagina does not expand, and she usually does not feel erotic sensations. Some of the most common causes of this dysfunction are guilt, anger and hostility.

Female Orgasmic Disorder is defined as a persistent or recurrent delay in, or absence of, orgasm in a female following a normal sexual excitement phase. Women exhibit wide variability in the type or intensity of stimulation that triggers orgasm. The diagnosis of Female Orgasmic Disorder is based on a clinician's judgment that the woman's orgasmic capacity is less than would be reasonable for an average woman of her age, sexual experience, and the adequacy of sexual stimulation she receives. Causes of Female Orgasmic Disorder include open or suppressed anger or hostility toward her partner, grief, or ineffective sexual techniques. Other causes of this dysfunction include familial, cultural or religious teachings that lead the woman to avoid or discourage effective sexual stimulation. Sometimes partners simply do not know how to give or receive effective stimulation.

Vaginismus is defined as a recurrent or persistent involuntary spasm of the musculature of the outer third of the vagina that interferes with sexual intercourse. The original cause of this dysfunction is frequently an adversive stimulus (such as a traumatic assault or intercourse, or painful pelvic examination), pelvic disease or unconscious fear or guilt.

Male Erectile Dysfunction is defined by the Diagnostic and Statistical Manual as a persistent or recurrent inability to attain, or maintain adequate erection until completion of the sexual activity. Erectile dysfunction is also due to the impairment of the erectile reflex. Erectile dysfunction (impotence) can have organic (i.e., medical) causes or psychological causes. Among the most common medical causes are diabetes or other endocrine problems, nerve dysfunction such as spinal cord injury or multiple sclerosis, vascular disease, medications including antihypertensive, centrally acting, sedative and psychotropic medications. Alcohol and drug abuse also commonly lead to this sexual dysfunction. Anxiety seems to be the most likely psychological cause of erectile dysfunction.

Male Orgasmic Disorder is defined as a persistent or recurrent involuntary delay in, or absence of, orgasm following a normal sexual excitement phase during sexual activity that a clinician, taking into account the person's age, judges to be adequate in focus, intensity, and duration. This disorder is fairly rare. Premature Ejaculation is defined as persistent or recurrent ejaculation with minimal sexual stimulation or before, on, or shortly after penetration and before person wishes it. Premature Ejaculation rarely has a physical cause (such as infection of the urethra and prostate, neglected gonorrhea, or an overly tight uncircumcised foreskin) but usually a psychological cause.

Additionally, the Diagnostic and Statistical Manual describes Inhibited Sexual Desire in males or females as another disorder, but strictly speaking not a sexual dysfunction. This disorder can severely disrupt the sexual relationship of a couple. Inhibited Sexual Desire is defined as a persistent or recurrent deficiency (or absence) in sexual fantasies and no desire for sexual activity. Both physical and psychological factors contribute to Inhibited Sexual Desire and similar disorders such as Hypoactive Sexual Desire Disorder and Sexual Aversion Disorder. Physical causes include hormone deficiencies, depression, stress, alcoholism, kidney failure and chronic illness. Psychological causes include relationship problems (power struggles, conflict, hostility), sexual trauma, death of a family member, or negative memories The treatment of the above-described sexual dysfunctions (or disorders) can focus on medical therapy and/or psychotherapy. Medical therapy focuses on the diagnosis and treatment of underlying physical causes (such as diabetes, hormone deficiencies, depression, alcoholism, kidney failure, chronic illness or medication use). Specific medical treatments commonly used to treat sexual dysfunction and impotence include drug therapy (such as testosterone or Viagra), vacuum constriction devices (VCDs), penile injection therapy with vasoactive drugs, and penile prostheses. Psychotherapy and behavior therapy is used to resolve sexual dysfunction caused by emotional and mental problems.

A suitable environment may play an important role in treating the above described dysfunctions or disorders. Many people have physical constrains that may limit their sexual or intimate relationship with their partner in bed.

Beds are the principal place for intimate or sexual activity, but they may have for many people limitations for several reasons. Beds are designed for sleeping and not specifically for engaging in intimacy, foreplay, lovemaking and intercourse, all of which are an occasional secondary function. In general, a two-dimensional mattress offers a limited opportunity for positioning and sustaining the human torso and limbs in sexually exciting and pleasurable positions. Usually, both partners are being supported on the same wide horizontal surface, which restricts easily achievable and sustainable angles of penetration.

Furthermore, beds require people to be mostly in a supine position for sexual intercourse and usually require one person to support the other's weight, or if not, for the other person to be kneeling or squatting. Many people, especially those that are overweight, or those who suffer certain physical disabilities, find it difficult or uncomfortable to engage in sexual intercourse while supporting the weight of their partner in a supine position. Other people have difficulty kneeling or squatting for any duration of time.

Since beds are primarily designed for sleeping, there may be an initial miscommunication between partners. One partner may be prepared for sleeping, while the other may wish to engage in intimate activities. Unless there is communication and agreement between partners, bed can be a source of sexual confusion, frustration and dissatisfaction, which can contribute to the above-described dysfunctions.

In addition to a bed, there are various other conventional furnishings or surfaces that humans have used for intimacy, foreplay, lovemaking and intercourse such as tables, desks, counters, chairs, floors, weight benches, etc. While some of these avoid some of the two dimensional limitations of the bed, they have limitations of their own. They do not adjust in height or angle so as to support the participants' torso and limbs at various levels of elevation, or at appropriate angles to facilitate a wider range of positions for sexual activity.

Some men (including those with some physical disabilities) find it more comfortable to engage in sexual intercourse in a standing position, others may prefer a position with both partners sitting. Neither the bed nor most conventional furniture facilitate comfortably these sometimes preferred positions.

Thus, there is a need for an apparatus or method capable of assisting most people, (including those who are overweight, have physical disabilities, or experience a sexual dysfunction) in improving their intimacy, foreplay, lovemaking or sexual intercourse.

SUMMARY OF INVENTION

The present invention pertains to apparatuses and methods for supporting a human body during an intimate activity that we define herein as including massaging, foreplay, lovemaking, sexual intercourse, or other intimacies couples may be engaged in with each other. The novel apparatus may include a base connected to an adjustable frame and a support surface for at least partially supporting the human body.

In general, according to one aspect, an apparatus for at least partially supporting a human body during an intimate activity includes a base coupled to a frame connectable to a first support surface constructed to be adjusted to a first selected position.

According to another aspect, an apparatus for at least partially supporting a human body of at least a first human during an intimate activity of two humans, includes a base coupled to a frame connectable to a first support surface constructed to be adjusted to a first selected position, and at least one handle constructed and positioned for holding by a second human.

According to yet another aspect, an apparatus for at least partially supporting a human body during an intimate activity, includes a base coupled to an adjustable frame constructed to bear weight of two support surfaces, wherein the two support surfaces are independently removable from the frame and are independently adjustable to assume first and second selected positions.

Preferably, the above apparatuses may include one or more of the following features:

The frame includes a main rail connectable to a first rail arranged to bear weight of the first support surface and constructed to displace the first support surface to the selected position. A "rail" is defined here as a structural member having a rectangular, circular, oval, I-shaped, N-shaped or similar cross-section, and providing a certain amount of strength for supporting another member of the apparatus.

The first support surface includes a narrow front portion. The narrow front portion of the first support surface is about 2 to 10 inches, and preferably about 4 to 6 inches wide. The first selected position has a selected height of the first surface above the floor surface. The first selected position has a selected angle of the first surface relative to the horizontal surface. The first support surface has a selected angle in the range from about 20 degrees of the surface front below the horizontal plane to about 20 degrees above the horizontal plane. The first support surface includes a seat.

The above apparatus may further include a second surface constructed to be adjusted independently of the first surface and be located at a second selected position. The second selected position has a selected height of the second surface above the floor surface. The second selected position has a selected angle of the second surface relative to the horizontal surface. The selected angle is in the range from about 20 degrees below to about 110 degrees above the horizontal plane, and preferably the range from about 20 degrees below the horizontal plane to about 90 degrees relative to the horizontal plane.

The frame may further include a second rail connectable to the main rail and arranged to bear weight of the second support surface, wherein the second rail is independently positionable relative to the first rail and is constructed to. displace the second surface to the second selected position. The second support surface may include a backrest. The second support surface may be constructed and shaped for resting elbows.

The adjustable frame may be constructed, after removing the support surfaces, to receive and support weight of one of the following: a table surface, a weight bench surface, a chair surface, and several cushions forming a couch.

The above apparatus may further include a third surface constructed to be adjusted independently of the first and second surfaces and be located at a third selected position. The third support surface may include a headrest or an elbow and forearm rest.

The above apparatus may further include a handlebar connectable to the frame. The handle bar is connected to the frame and has a holding surface at about the same height above the floor surface as the second surface. The handle bar is connected to the frame and has a holding surface at a height of about 2 to 20 inches above the first surface.

The frame may further include a third rail connectable to the main rail and arranged to bear weight of the third support surface, wherein the third rail is independently positionable relative to the first and second rails and is constructed to position the third support surface to the third selected position.

In general, a hand hold may be in the form of a handlebar connectable to the frame at various locations and heights. For example, the handlebar may be connected to the frame protruding from the sides of the support surfaces and may have a holding surface at about the same height above the floor surface as the second surface. The handle bar may be connected to the frame and have a holding surface at a height of about 2 to about 20 inches above the first surface. The handlebar may be a straight of a curved handlebar, made of a metal or plastic tube, attached at the top and bottom of the first or second rail to give the users a range of locations to grab onto to gain arm leverage. The present apparatuses provide hand holds for either of the participants so that they can use their arm strength to facilitate the positioning and holding in place their bodies and limbs. This is particularly beneficial not only for overweight or physically handicapped people, but for all other people, during an intimate activity.

The frame may be constructed from aluminum, steel, plastic or another material. The material may be formed using a variety of processes including extruding, cutting, bending, welding, bolting, molding, casting or monocoque. The seat, backrest, headrest may be constructed from a vinyl pulled over foam and stapled to plywood, injection molded plastic, roto-molded plastic, thermoformed plastic, or other materials used in the art. Other attachments and accessories may be constructed from a variety of conventional materials using conventional processes.

According to yet another aspect, a method of performing an intimate activity by two humans is practiced using an apparatus for at least partially supporting a body of at least one human, including a base coupled to a frame connectable to a first support surface. The method includes the steps of adjusting the first support surface to a first selected position; supporting at least partially the body of a first human on the adjusted first support surface; and performing an intimate activity by the two humans. The apparatus may further include a second surface constructed to be adjusted independently of the first surface of the apparatus. The method may include adjusting the second support surface to a second selected position prior to the supporting of the first human on the first support surface; and supporting at least partially the body of the first human by the adjusted second support surface prior to performing the intimate activity.

Advantageously, the above-described apparatuses support, in a stable manner, a user's torso or limbs in a wide range of positions, angles and elevations. These positions facilitate various intimate activities including, but not limited to, intimacy, foreplay, lovemaking and sexual intercourse.

Additionally, the apparatuses provide several attachment points on the frame so that a user can affix additional devices including leg rests or other devices for supporting the legs or feet or a participant, handholds, small platforms or stands for a video monitor or speakers, or holders for various objects used during the intimate activities.

The apparatuses also provide a platform or a frame and an attachment system for a variety of specialized seats, chairs, table tops, or other support surfaces, which can be easily exchanged and supported by the frame. These support surfaces can convert the function of the apparatus into a sofa, an armchair, a sleeping or massage surface, a weight bench, a counter, a table, or another piece of furniture. The apparatuses may include a frame that can be disassembled or "collapsed" so that the apparatus can be stored away.

The present invention will next be explained in connection with the following description of preferred embodiments and enclosed drawings.

DETAILED DESCRIPTION OF PREFERRED EMBODIMENTS

Figure 1:
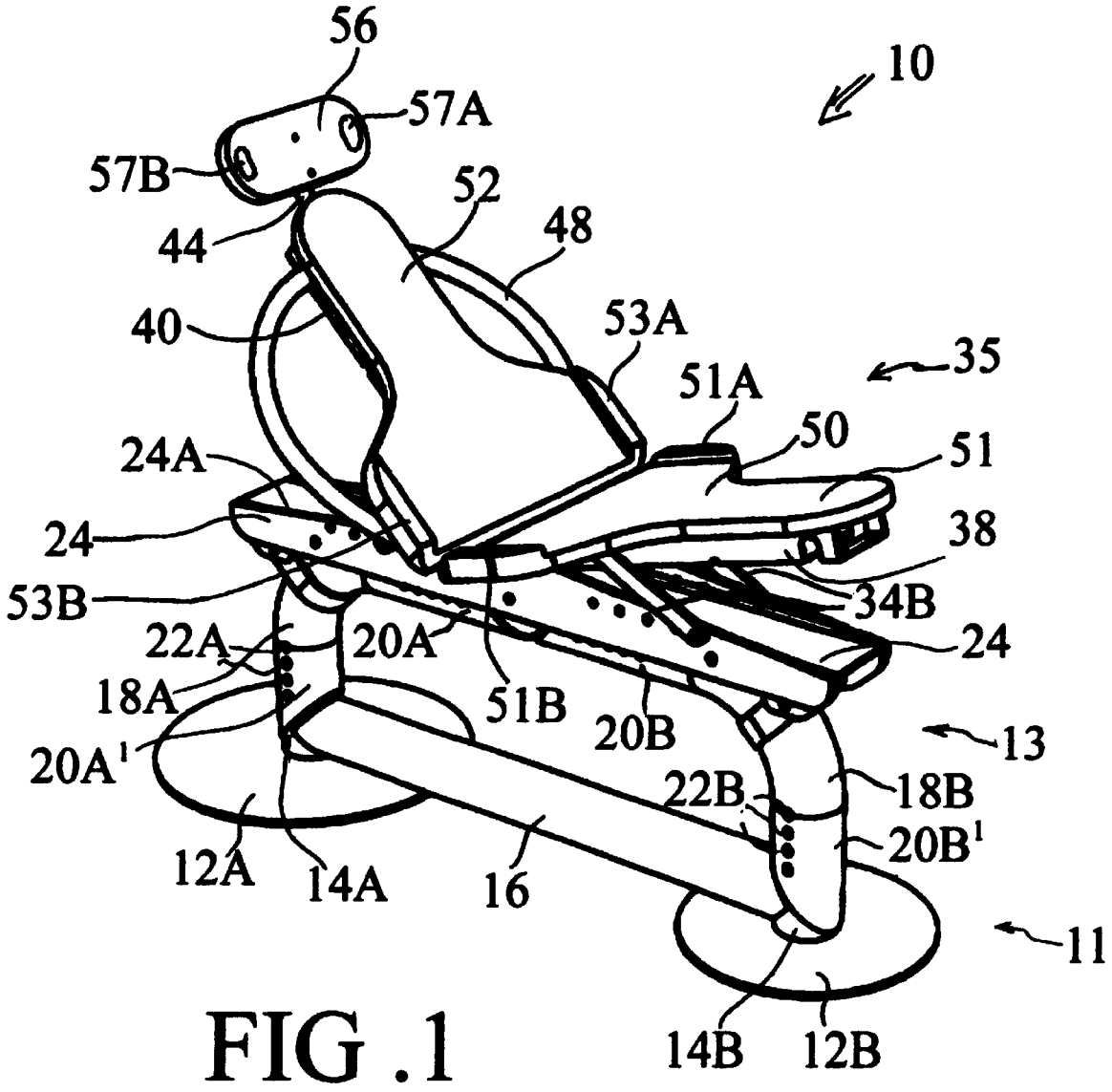
FIG. 1 is a perspective front view of an apparatus for supporting a human body during intimate activities.
Figure 1A:
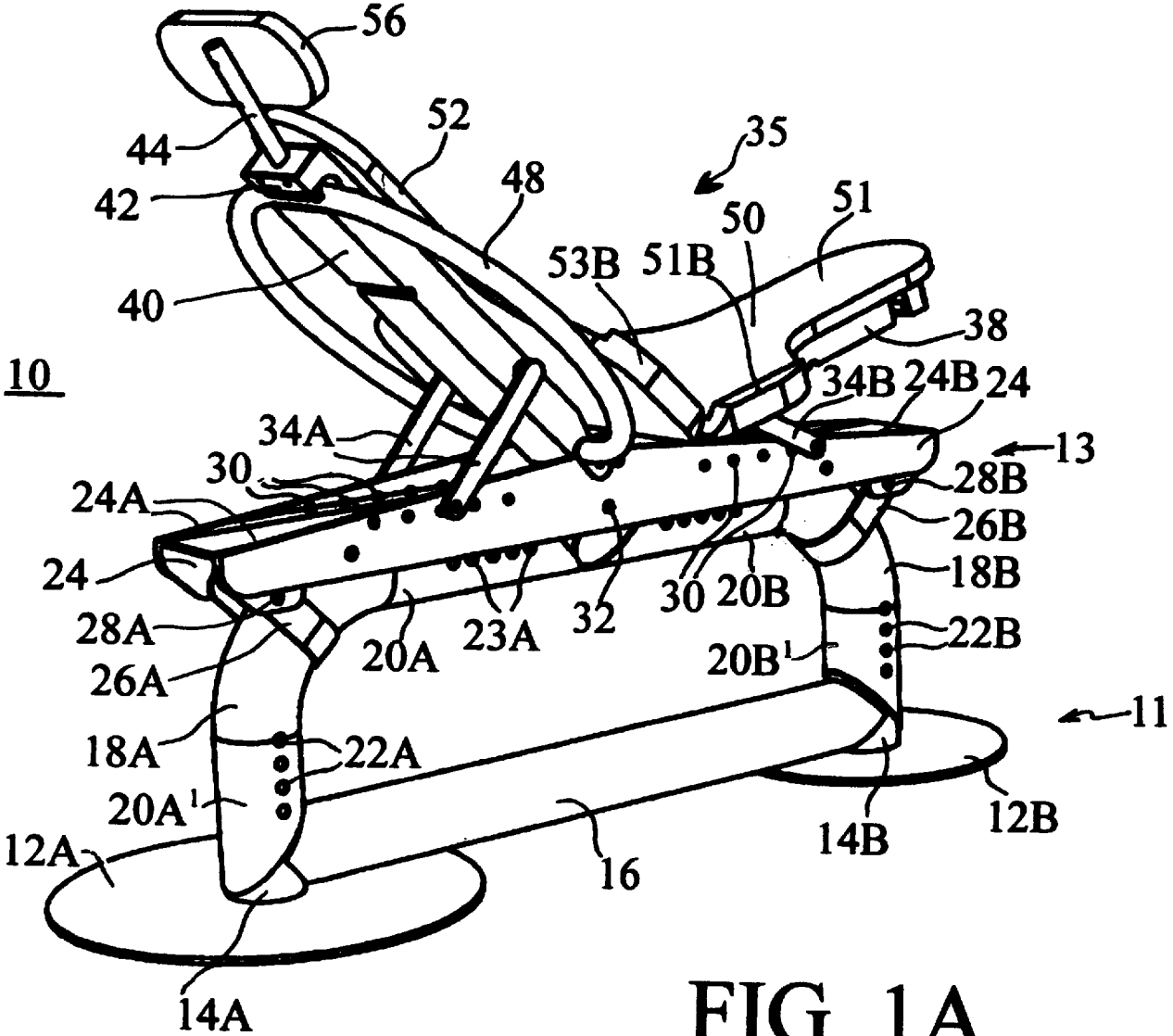
FIG. 1A is a perspective rear view of the apparatus of FIG. 1.
Figure 1B:
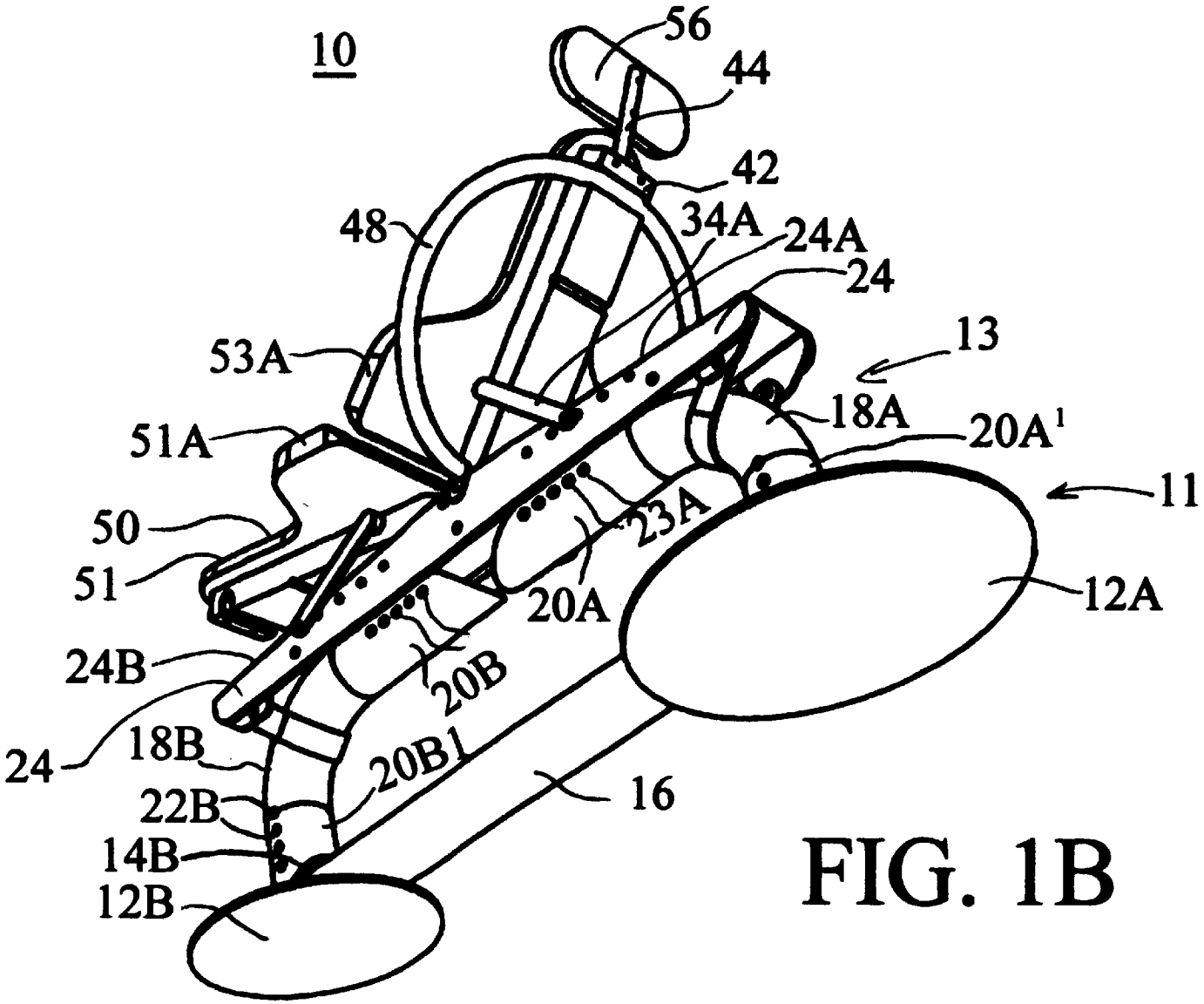
FIG. 1B is a perspective bottom view of the apparatus of FIG. 1.

FIGS. 1, 1A and 1B depict a preferred embodiment of an apparatus 10 for supporting a human body during an intimate activity such as massaging, foreplay, lovemaking, sexual intercourse, or other intimacies couples may be engaged in with each other. Apparatus 10 includes a base, generally shown by arrow 11, connected to an adjustable frame, generally shown by arrow 13, and one or several support surfaces for supporting at least partially a human body, generally shown by arrow 35. Base 11 includes a rear plate 12A connected to a base leg 14A, a front plate 12B connected to a base leg 14B, and a base tube 16 connecting base legs 14A and 14B. Adjustable frame 13 includes two adjustable height legs called slider legs connectable to a main rail 24, a seat rail 38, a backrest rail 40, handlebar 48, and a headrest rail 44. Surface 35 for supporting a human body includes a seat 50, a backrest 52, and a headrest 56.

Adjustable frame 13 is constructed for positioning surfaces 35 at different angles and at different heights from about 4 inches to about 40 inches above the floor, wherein each surface may be adjusted independently. The height is primarily adjusted by the front and rear slider legs. The rear slider leg includes an angular portion 18A connected to two straight portions 20A and 20A'. The front slider leg includes an angular portion 18B connected to two straight portions 20B and 20B'. The rear slider leg is connectable by a U-bracket 26A to a slider leg pivot 28A, which is connected to main rail 24. The front slider leg is connectable by a U-bracket 26B to a slider leg pivot 28B, which is again connected to main rail 24. Straight portions 20A and 20A' may have different lengths, wherein portion 20A' includes a set of brace attachment points 22A, and portion 20A includes a set of brace attachment points 23A. Similarly, straight portions 20B and 20B' may have different lengths and may be symmetrical with straight portions 20A and 20A'. Portion 20B' includes a set of brace attachment points 22B, and portion 20B includes a set of brace attachment points 23B, arranged to adjust the height, and possibly the angle, of positioning surfaces 35.

Surfaces 35 for supporting a human body are adjustably attachable by rails 38 and 40 to main rail 24. Main rail 24 includes support surfaces 24A and 24B, which are positioned at selected angles to accommodate selected positions of backrest 52 and seat 50, respectively. Adjustable frame 13 also includes a pair of rear braces 34A and a pair of front braces 34B connectable to main rail 24 at different brace attachment points 30. Main rail 24 and rear braces 34A are cooperatively arranged to position backrest rail 40 at a selected angle with respect to base 11. Similarly, front braces 34B are cooperatively arranged with main rail 24 to position seat rail 38 at a selected angle with respect to base 11. Seat 50 is attached (or removably attachable) to seat rail 38, and backrest 52 is attached (or removably attachable) to backrest rail 40. Headrest rail 44 is connectable to backrest rail 40 and is constructed to support headrest 56.

Seat 50, backrest 52 and headrest 56 are separately adjustable to assume different heights and relative angles with respect to each other. Seat 50 includes a seat nose 51 and a pair of seat shoulders 51A and 51 B. Backrest 52 includes backrest shoulders 53A and 53B. The surfaces of seat 50 and backrest 52 are soft or padded to give comfort to a sitting or kneeling person. Specifically, a soft layer is supported by a harder substrate, which may be slightly concave to provide resistance so that the buttocks of a sitting person will not easily roll off. Seat nose 51 is shaped to make it easy for one of the participants, while facing backrest 52, to straddle seat nose 51 while standing or sitting. Furthermore, seat nose 51 and shoulders 51A and 51B may also be shaped to provide kneeling cushions for a person kneeling over backrest 52. (Alternatively, the entire seat may be narrow throughout its length so that it can be straddled throughout its length.)

Adjustable frame 11 is made of aluminum, steel, plastic, or another material, or the individual pieces may be constructed of different materials. Base tubes 14A and 14B are fastened (welded, or a part of a cast) to tubes 20A' and 20B', respectively, each having, for example, a set of holes drilled completely through at one inch intervals to accept a bolt or another fastener. Angular portions 18A and 18B may be bent at about 90 degrees and connected to respective straight portions 20A and 20B, which include also holes drilled through, at standard intervals of, for example, one inch. Furthermore, either end of each slider tube may slide over tube 14A (or 14B). Tube portion 20A may be longer than a tube portion 20A', and similarly tube portion 20B may be longer than a tube portion 20B'.

As mentioned above, the front and rear slider legs include straight portions 20A, 20A', 20B and 20B' constructed for adjusting the height of the support surfaces. Because tube portion 20A has a different length than tube portion 20A' (and also may have a different distribution of hole sets 22A and 23A), a user can position the top of seat 50, in selected increments, from about 10 inches to 50 inches, and preferably 15 inches to 30 inches above the floor. Typically, the height of portion 20A' and 20B' of the slider leg moves in parallel. However, the legs may be deliberately positioned at an angle so that main frame 24 is not oriented horizontally to the floor. The front and/or rear slider legs may include an additional mechanism for assisting the height adjustment such as a pneumatic lift, a hydrolic lift, tension devices, gears or a lever.

Adjustable frame 13 includes main rail 24, which is about 34 to 42 inches long (and preferably 38 inches long) about 5 inches wide and about 4 inches high. Seat rail 38 and a backrest rail 40 are about 15 to 25 inches long, and preferably 20 inches long, and about 3 to 5 inches wide, and preferably 4 inches wide. Base tube 16 is about 35 to 45 inches long, and preferably 40 inches long. Base plates 12A and 12B have a diameter of about 8 to 24 inches, and preferably base plate 12A has a 16 inch diameter, and base plate 12B has a 12 inch diameter. Seat 50 and a backrest 52 may be about 20 to 30 inches long (preferably 25 inches long) and about 10 to 30 inches wide at their shoulders (and preferably 24 inches wide). Seat nose 51 is about 4 to 10 inches wide and preferably 6 inches wide. Headrest 56 may be about 6 to 12 inches wide and high, and preferably 8 inches wide and 12 inches high.

In a different embodiment, the sliders can have two sets of straight tubes having different lengths. Instead of rotating the slider leg to use different lengths of portions 20A and 20A', a user would use the shorter tubes for a height from about 16 inches to about 22 inches, and would use the longer tubes for a height of about 23 inches to about 30 inches. The connections to tubes 14A and 14B would be the same, but the connection to main rail 38 would likely be different. In another embodiment, the shorter length set of slider tubes has a smaller diameter than the longer length slider, so that it fits snugly inside of the longer slider and the two tubes "telescope" out to achieve a longer range of height adjustments.

Two U-brackets 26A and 26B may be welded to tubular members 18A and 18B, respectively, and are attached by a fastener to brackets 28A and 28B. Brackets 28A and 28B may be welded to the main rail 24. (Alternatively, the attachment point of brackets 28A and 28B may become a part of main rail 24. Main rail 24 in this case may be produced by custom extrusion or cast or mold.)

The headrest includes a rectangular or oval block 56 connected to headrest rail 44 which fits into a handlebar clamp 42 attached to backrest rail 40. Headrest block 56 is padded similarly as described for seat 50. Optionally, headrest block 56 may include two speakers 57A and 57B (shown in FIG. 1) for playing music or other sounds. Headrest rail 44 may include a set screw for holding support block 56 in place. Headrest rail 44 may be removed from rail 40 and another rail attached to another type of support may be inserted in its place.

Preferably, main rail 24 is an I beam with the top web tapered from the middle to both ends, forming surfaces 24A and 24B. Surfaces 24A and 24B allow backrest rail 40 and seat rail 38 to lie at about 20 degrees (and preferably 10 degrees) below the horizontal plane when located at their lowest positions. Seat rail 38 and backrest rail 40 are connected to main rail 24 by separate pivot points. Rear braces 34A are fastened to backrest rail 40, and front braces 34B are fastened to seat rail 38 by rotating joints or pins, allowing seat 50 and backrest 52 to be adjusted to several angles from the horizontal plane. Alternatively, pairs of brackets 34A and 34B may be replaced by a single bracket on each side or by other height adjustment devices, including pneumatic tubes. Main rail 24 also includes attachment holes 32 for allowing additional devices to be attached, such as hand holds, foot rests, etc.

Seat rail 38 and backrest rail 40 can be detached from main rail 24 and placed on the floor so as to accommodate the height of a person kneeling or squatting. Seat rail 38 and backrest rail 40 may be rectangular or U-shaped tubes. Handlebar 48 is made of a tube or rod, and is bent into a circle or may have another curvature. Handlebar 48 is attached to the top of backrest rail 40 by a slot in clamp 42, and is also attached to the bottom of backrest rail 40. Handlebar 48 provides a device for the participants to hold onto.

Seat 50 and backrest 52 are positioned on seat rail 38 and backrest rail 40 partially by gravity and by using male plugs placed into female receptacles. Back base plate 12A and front base plate 12B can be made from different thickness of material and may be round, oval, or rectangular and are constructed to provide stability for adjustable frame 13. Back base plate 12A and front base plate 12B may be replaced by an "A" shaped frame, a curved frame, or "V" shaped frame again constructed to provide stability for adjustable frame 13. Other attachment ways such as hooks or nuts and bolts may also be used.

Figure 2:
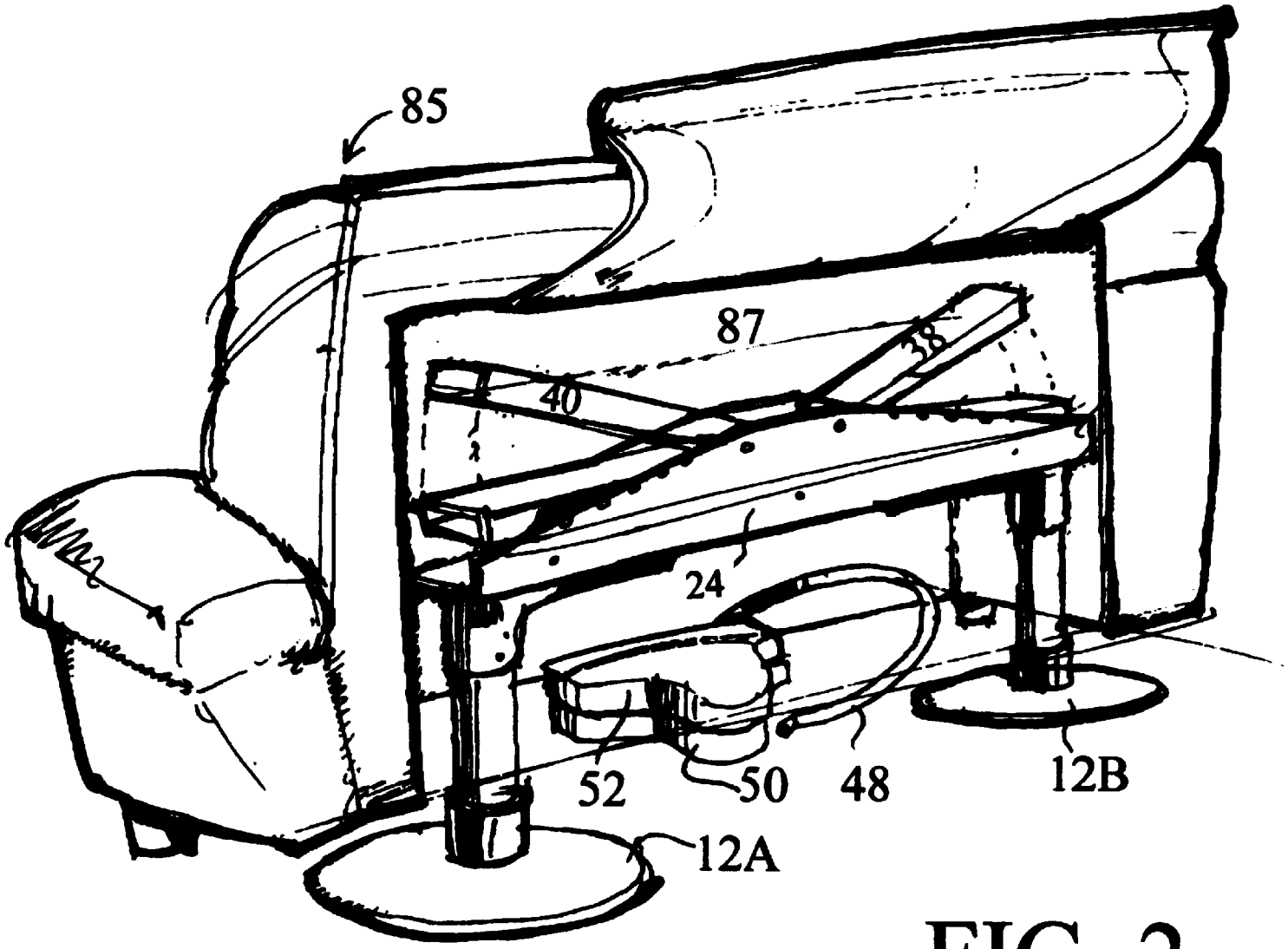
FIG. 2 is a perspective side view of the apparatus 10 of FIG. 1 inside a sofa.

FIG. 2 is a perspective side view of the above-described apparatus 10 positionable inside a sofa 85. Apparatus 10. has support surfaces 35 removed and adjustable frame 13 folded and located inside a cavity 87 formed in sofa 85. Cavity 85 may be sufficiently large to accommodate also seat 50, backrest 52 and headrest 56. According to another embodiment, the cushions of sofa 85 can be mounted directly onto adjustable frame 13, after seat 50, backrest 52 and headrest 56. In this embodiment, the weight of sofa 85 and any humans sitting on the sofa will be supported by frame 13. Removed seat 50, backrest 52 and headrest 56 may be stored between plates 12A and 12B under tubular elements 20A and 20B.

Figure 2A:
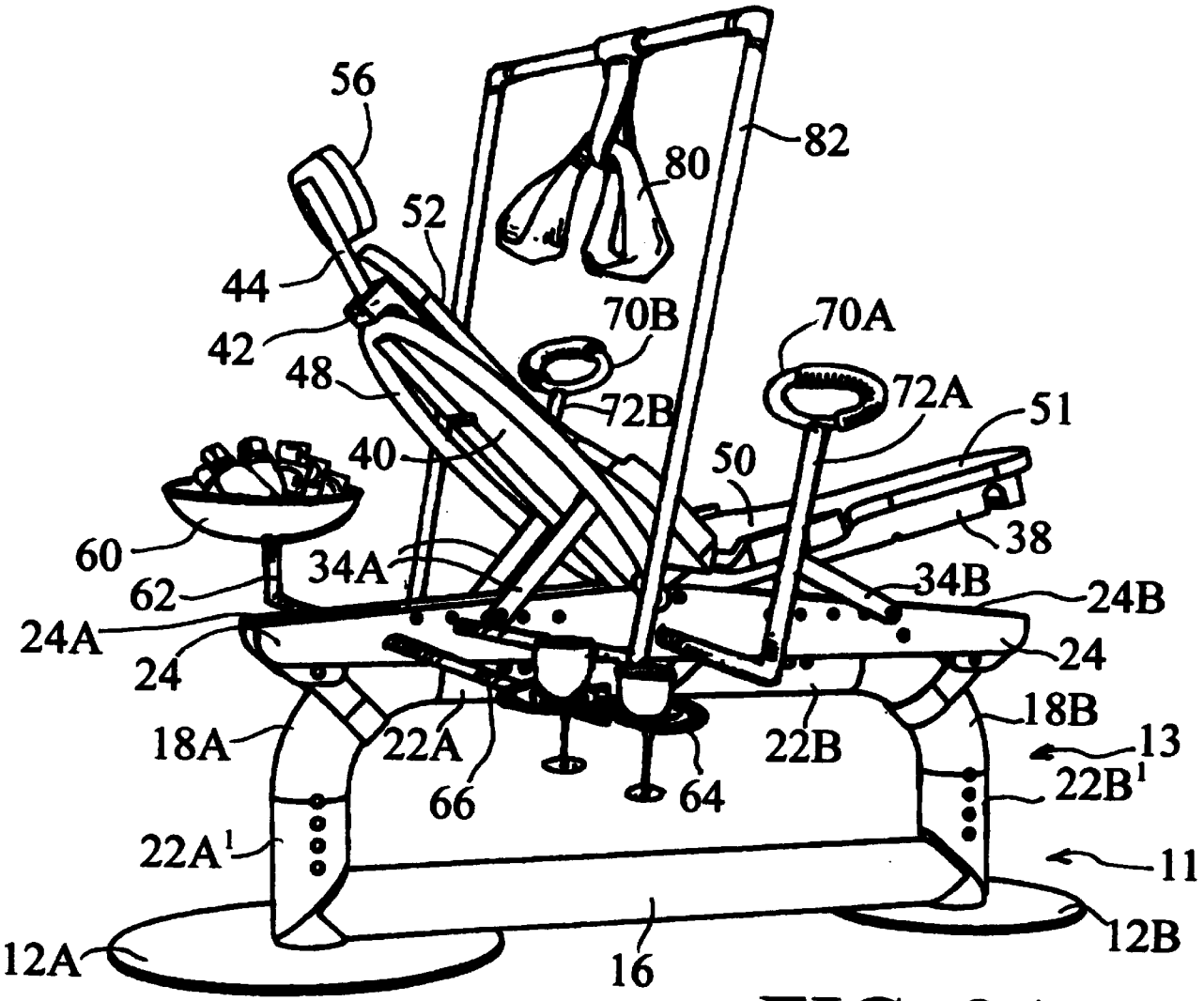
FIG. 2A is a perspective rear view of the apparatus of FIG. 1, including several optional attachments.

FIG. 2A is a perspective rear view of the above-described apparatus 10 including several optional-attachments. Main rail 24 includes attachment holes 32 arranged for receiving optimal devices 60, 64, 70A and 70B, and 80. A tray 60 is connected to an L-shaped support rod 62, and is arranged to hold various objects, for example, a bottle of champagne on ice. Apparatus 10 may also include glass holders 64 connected to main rail 24 by a rod or tube 66. Additionally, apparatus 10 may also include foot rests 70A and 70B connected to main rail 24 by L-shaped support rods 72A and 72B, and may include hand holds 80 attached to main rail 24 by a rod or tube 82.

Figure 3:
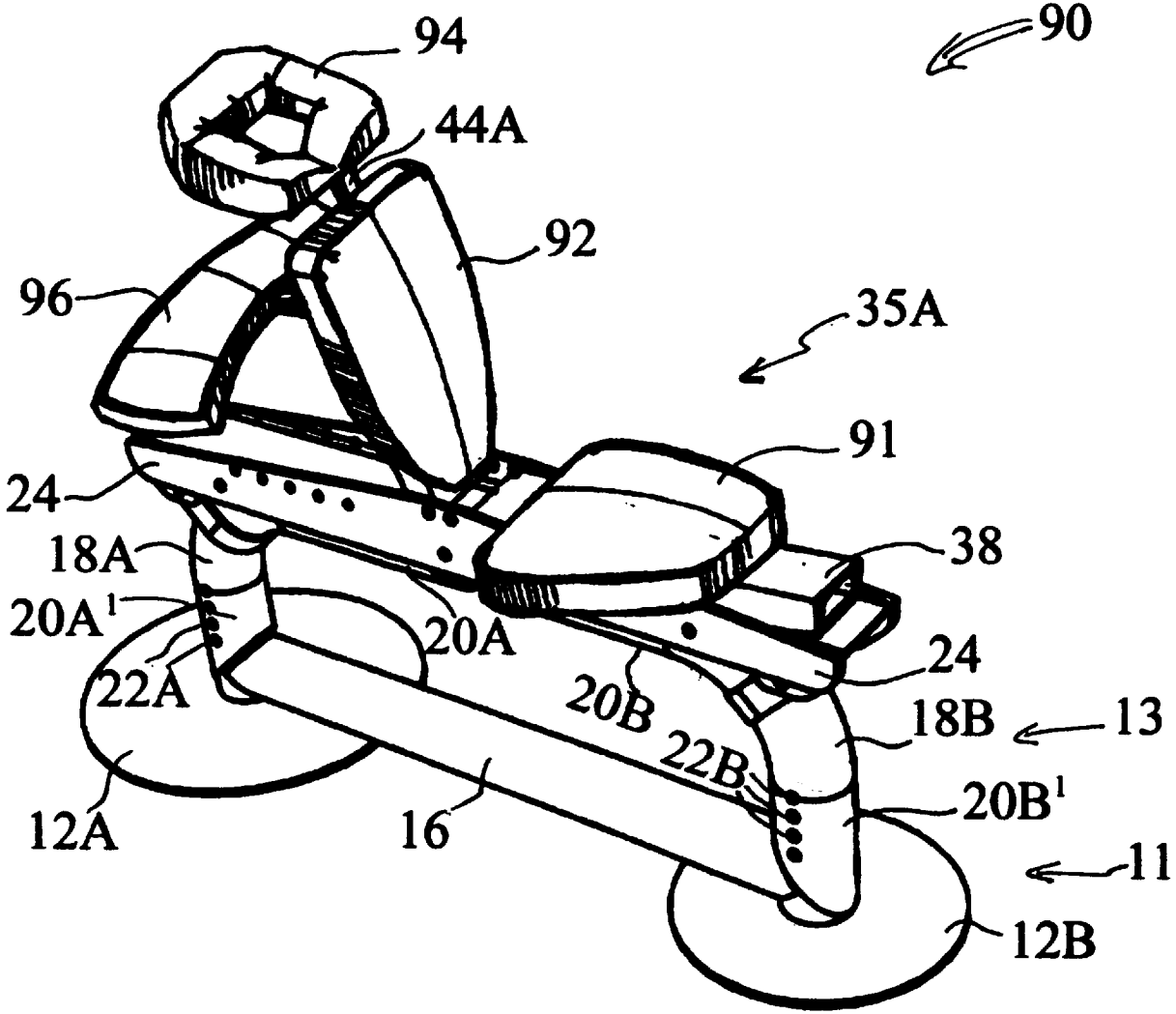
FIGS. 3 and 3A are perspective side views of other embodiments of the apparatus of FIG. 1.

FIG. 3 is a perspective side view of another embodiment of the apparatus for supporting a human body during an intimate activity. Apparatus 90 is particularly useful as a massage chair. Apparatus 90 includes base 11 and adjustable frame 13 (both of which were described in connection with FIGS. 1, 1A and 1B), and includes a seat 91, a chest support 92, a face support 94, and a forearm support 96. Seat 91 is removably attachable to seat rail 38, and chest support 92 is removably attachable to backrest rail 40. Face support 94 is removably attachable to headrest rail 44 (or is permanently attached to a removable headrest rail 44A. Seat 91, a chest support 92, a face support 94, and a forearm support 96 are separately adjustable to assume different heights and relative angles with respect to each other and with respect to the floor.

Figure 3A:
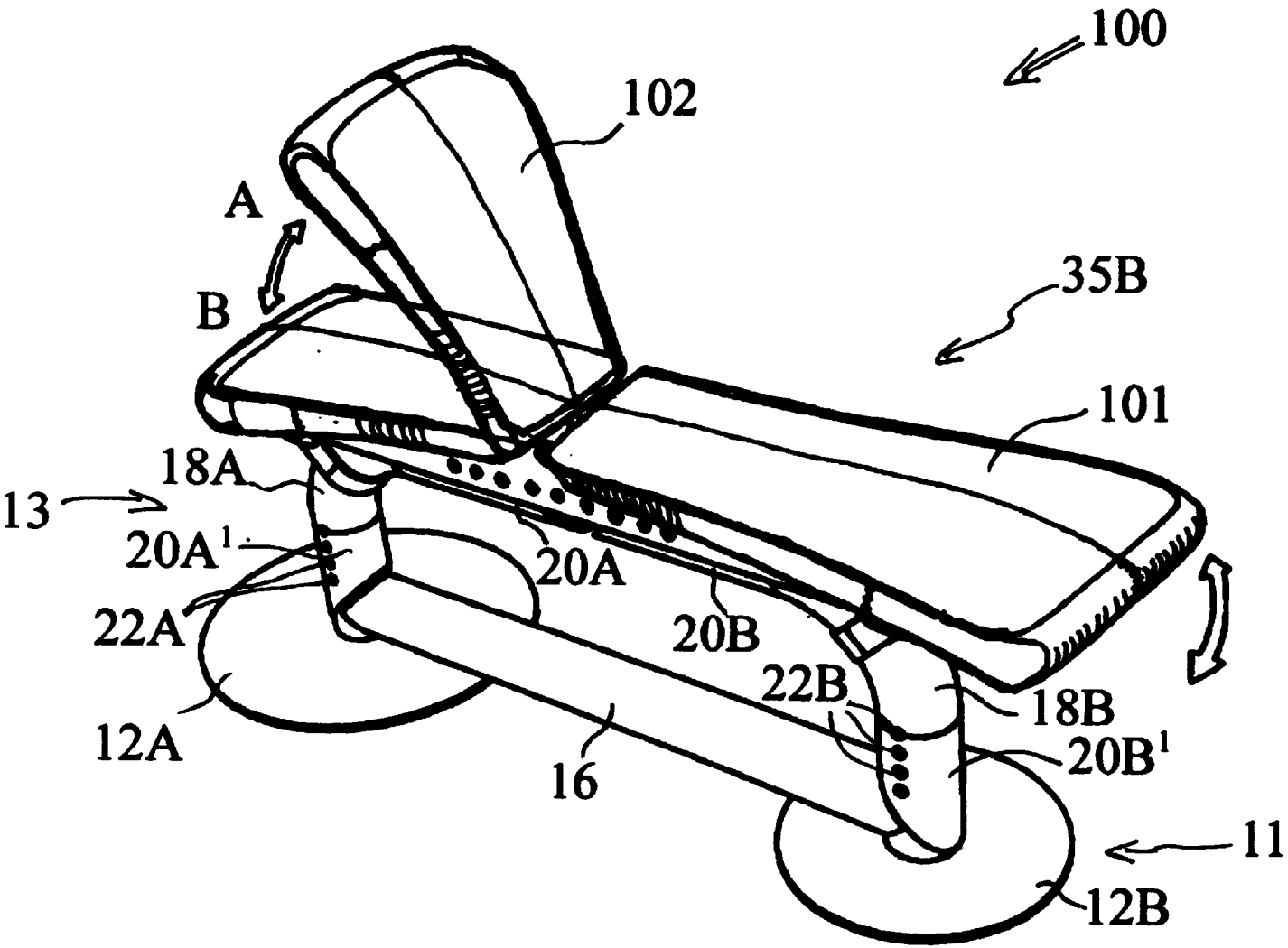

Referring to FIG. 3A, apparatus 100 is a perspective front view of another embodiment of the apparatus of FIG. 1. Apparatus 100 includes base 11 and adjustable frame 13 (both of which were described in connection with FIGS. 1, 1A and 1B), and includes supporting surfaces 35B formed by a lower support 101 and an upper support 102, which are primarily used as a weight bench. Alternatively, lower support 101 and upper support 102 may be fabricated as mattress-like supports with a hard back surface attachable to seat rail 38 and backrest rail 40. Both lower support 101 and upper support 102 may be independently raised and lowered, as shown by positions A and B, using the-above-described frame elements.

In general, adjustable frame 13 is constructed for removable, exchangeable surfaces 35, 35A or 35B (FIGS. 1, 3 or 3A), which can be independently moved to and locked at different angles and adjusted to different heights above the floor. Other surfaces such as lounge chairs, massage tables or other attachments may be also used to provide the user with other multiple usages. The entire apparatus can be easily assembled and disassembled to allow for space saving and storing (as shown in FIG. 2) or for portability.

Figure 4:
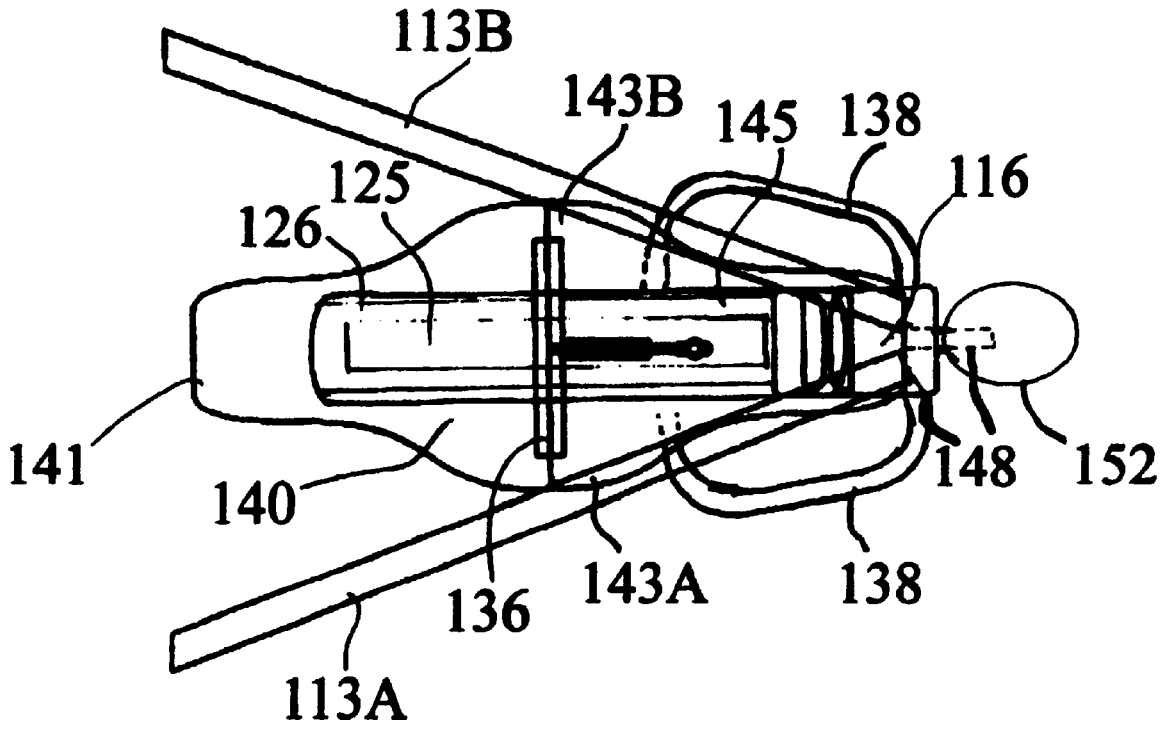
FIG. 4 is a top view of another embodiment of an apparatus for supporting a human body during intimate activities.
Figure 4A:
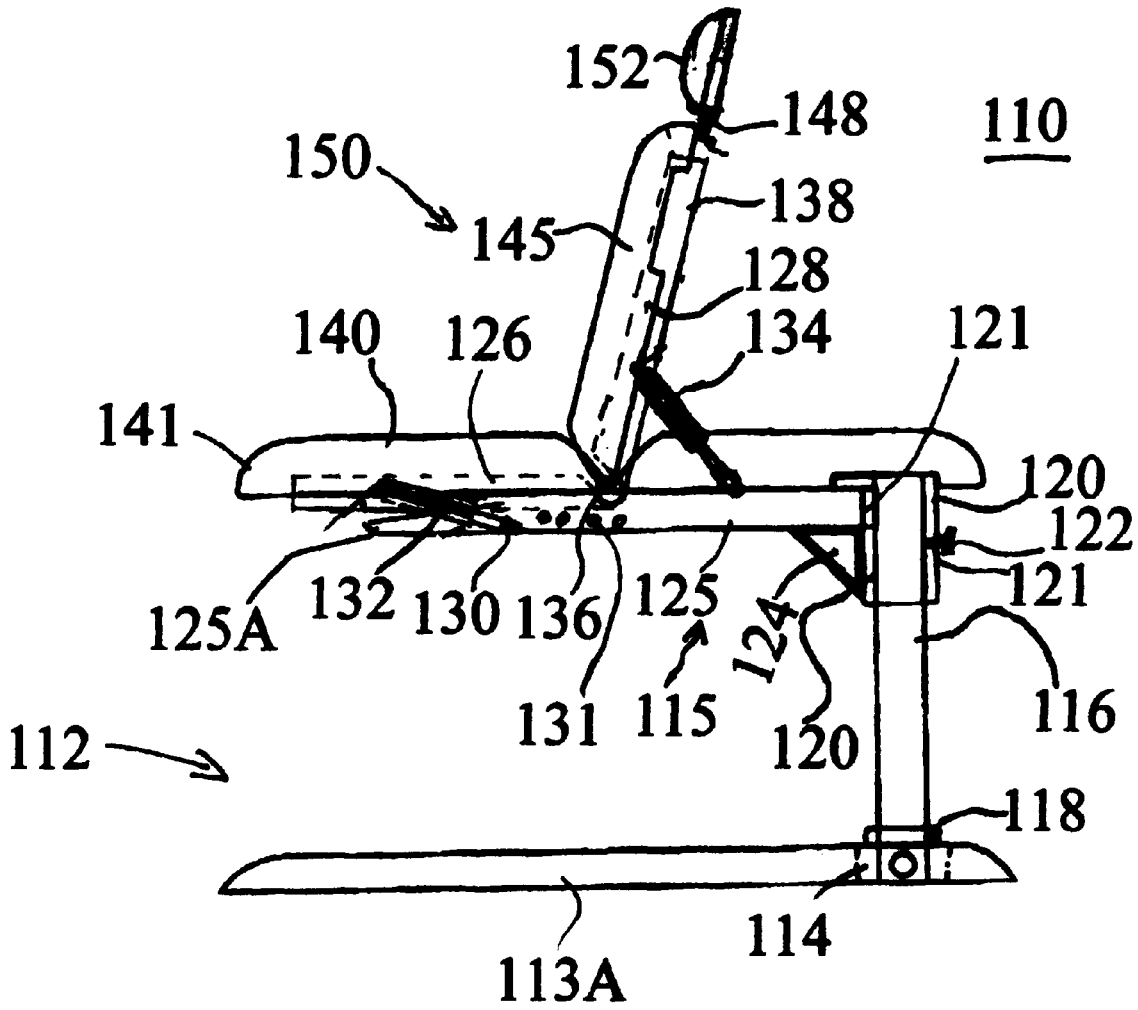
FIG. 4A is a side view of the apparatus of FIG. 4.

FIGS. 4 and 4A show another embodiment of an apparatus for supporting a human body including the human torso and limbs during intimate activities such as massaging, foreplay, lovemaking, or sexual intercourse. An apparatus 110 includes a base 112 connected to an adjustable frame 115, and one or several support surfaces (generally shown by arrow 150) for supporting at least partially a human body. Base 112 includes two base rods 113A and 113B (or another type of a platform) connected together at a cross member 114. Adjustable frame 115 includes a vertical post 116 and a main rail 125. Vertical post 116 is connected to a floor collar 118 and is connectable to a post collar 120. Post collar 120 includes a bracket 122 and a bolt 124 arranged for adjusting the height of main rail 125 relative to the floor. A connection (or weld) 121 connects post collar 120 and bracket 122 to main rail 125.

Adjustable frame 115 also includes a seat rail 126 and a backrest rail 128. Main rail 125 includes several attachment holes 130, which serve as attachment points for pneumatic lifts (or pistons) 132 and 134. Seat rail 126 and backrest rail 128 are attached to main rail 125 by a single pivoting joint 136 (or two separate joints). Handlebar 138 is attached to backrest rail 128. Furthermore, a headrest rail 148 is connectable to backrest rail 128. Surfaces 150 for supporting a human body include a seat 140, a backrest 145, and a headrest 152. Seat 140 is connected to seat rail 126, backrest 145 is connected to backrest rail 128, and headrest 152 is connected to headrest rail 148. All support surfaces, that is, seat 140, backrest 145, and headrest 152 are independently adjustable by adjusting the position of seat rail 126, backrest rail 128, and headrest rail 148, respectively.

Base 112 and adjustable frame 115 are made of aluminum, steel, plastic or another material. The shape of the stock may be round, oval, flat or rectangular. Base pieces 113A and 113B are joined via a cross piece 114, and flair out in a V-shaped pattern (or an A-shaped pattern or a curved pattern) to support the weight of apparatus 110 and at least one user. Furthermore, base pieces 113A and 113B are shaped and located to be out of the way of the feet of a standing or sitting user. Floor collar 118 may be a circle or a rectangle with an opening in the center to accommodate post 116. Vertical post 116 may have a round or rectangular or I-beam cross-section. Post collar 120 slides freely over the length of vertical post 116 from about the floor level to about 40 inches (and preferably 30 inches). Vertical post 116 can be locked in place at selected level using a bolt 121 with a handle 122.

Main rail 125 is made, for example, of an I-beam with the top web tapered from the middle to the end 125A, to allow seat rail 126 and seat 140 to be positioned at about 20 degrees (and preferably about 10 degrees) below the horizontal plane. Seat rail 126 and backrest rail 128 are attached to main rail 125 by pivoting joint 136 in a way that seat rail 126 and backrest rail 128 can open and close with respect to each other from about 90 degrees, in the "sitting mode," to about 200 degrees in the horizontal mode.

Furthermore, main rail 125 includes holes 131 through both lower webs for enabling additional devices to be attached to main frame 125. Pneumatic lifts 132 and 132 are fastened to seat rail 126 and to backseat rail 128, respectively, in a manner that facilitates the movement and fixing of seat 140 and backrest 145 at various angles to each other and to the horizontal plane. (Alternatively, these lifts may be replaced by other height adjustment devices.)

Seat 140 includes a narrower seat nose 141 and wider seat shoulders 143A and 143B. The surface of seat 140 is soft or padded to give comfort to a sitting or kneeling person. The soft layer is supported by a harder substrate. The seat edges may be slightly concave to provide resistance so that the buttocks of a sitting person will not easily roll off. Seat nose 141 may be shaped so that a person facing backrest 145 can easily straddle seat nose 141 while standing or sitting. Seat nose 141 and seat shoulders 143A and 143B may be shaped to provide kneeling cushions for a person kneeling over backrest 145. Alternatively, the entire seat 140 may be narrow throughout its length so that it can be straddled throughout its length.

Backrest 145 is also padded and may be shaped similarly as seat 140 (or may have a different shape). Handlebar 138 may be a round tube bent into a circle, or another curve, attached to the top and bottom of backrest rail 128. Handlebar 138 provides a convenient and sturdy surface for a participant to hold onto. Headrest 152 may also be made of a padded material and may have a round, oval or rectangular shape. In general, seat 140, backrest 145, or headrest 152 may be replaced by other surfaces such as lounge chairs, massage table tops, or weight bench tops, which provide users with multiple usages. Apparatus 110 can be easily assembled and disassembled to allow for space saving and storing and portability.

Figure 5:
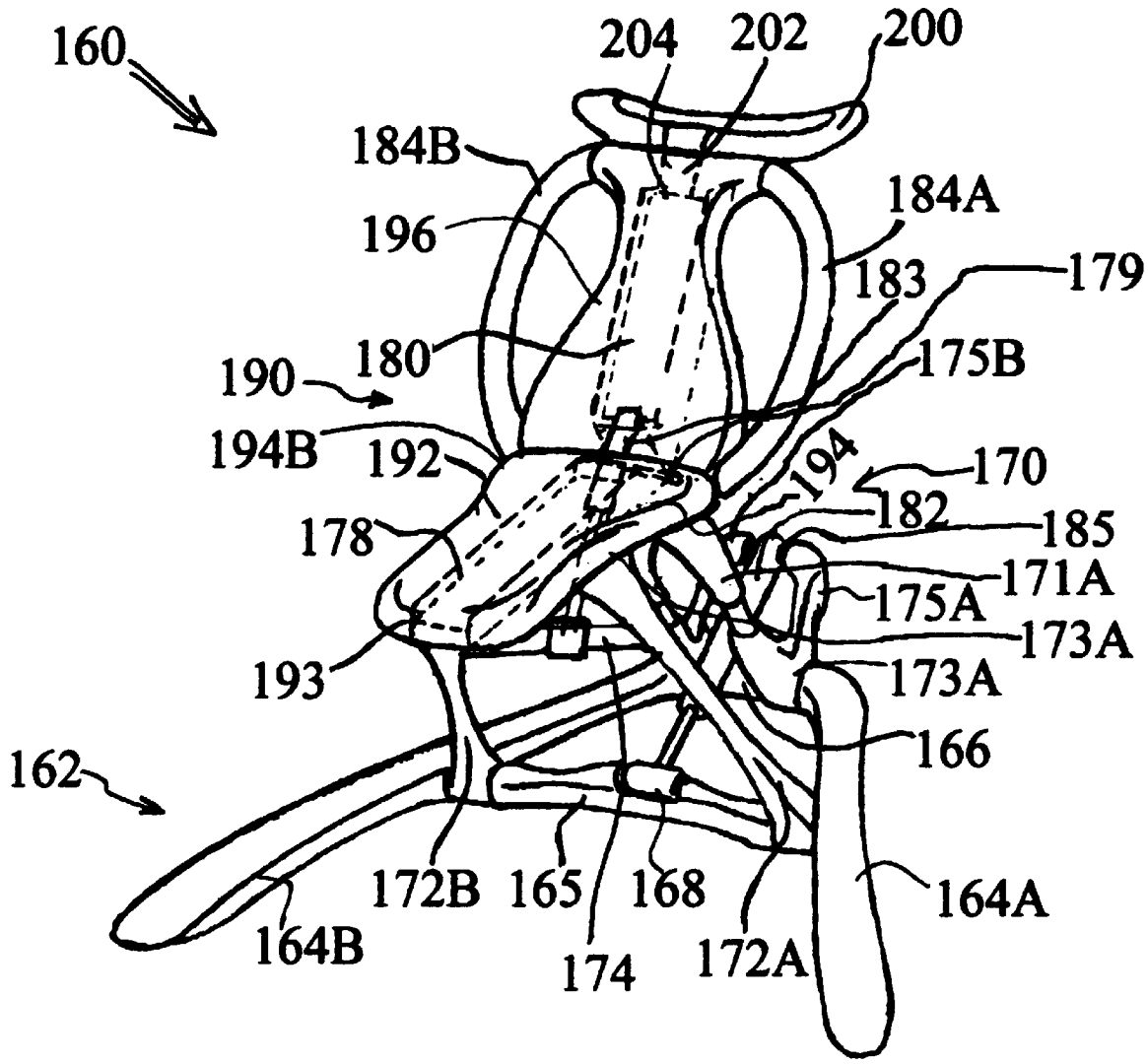
FIG. 5 is a perspective front view of yet another embodiment of an apparatus for supporting a human body during intimate activities.

FIG. 5 shows another embodiment of an apparatus for supporting a human body including the human torso and limbs during intimate activities such as massaging, foreplay, lovemaking, or sexual intercourse. An apparatus 160 includes a base 162 connected to an adjustable frame (generally shown as 170), and one or several support surfaces (generally shown by arrow 190) for at least partially supporting a human body. Base 162 includes two base members 164A and 164B (or another type of a base platform) connected together at a front cross member 165 and a rear cross member 166.

Adjustable frame 170 includes two rear vertical posts 171A and 171B, two front vertical posts 172A and 172B, a seat rail 178, and a backrest rail 180. Rear vertical posts 171A and 171B are connected to respective base members 164A and 164B at connection points 173A and 173B. Front vertical posts 172A and 172B are connected together by a horizontal cross support member 174. As described below, seat rail 178 and backrest rail 180 are adjustably coupled to adjustable frame 170 using two pneumatic lifts so that their relative position and orientation can be easily changed.

Adjustable frame 170 also includes two rear support members 175A and 175B, a lower pneumatic lift 182 and an upper pneumatic lift 183. Lower pneumatic lift 182 is connected to rear support members 175A and 175B by a connection rod 185, and is connected to front cross member 165 by a connection joint 168. Upper pneumatic lift 183 is connected to horizontal cross support member 174 and to a joint (not shown) that adjustably connects seat rail 178 and a backrest rail 180.

The surfaces (190) for at least partially supporting a human body include a seat 192, a backrest 196 and a headrest 200. Seat 192 is connected to seat rail 178, backrest 196 is connected to backrest rail 180, and headrest 200 is connected to a headrest bar 202. Seat 192 and backrest 196 are adjustable by the action of lower pneumatic lift 182 and upper pneumatic lift 183, which change the relative position of seat rail 178 and backrest rail 180. Headrest bar 202 is slidably and removably connected to backrest rail 180 at a connection 204. Headrest 200 can also be removed and replaced by another support surface coupled to rod 202.

Adjustable frame 170 is constructed to enable various positions of seat 192 and backrest 196 from about the floor level to about 40 inches (and preferably from about 10 inches to about 30 inches above the floor). Specifically, front vertical posts 172A and 172B are pivotably connected to front cross member 165 and are also pivotably connected to seat rail 178. Rear vertical posts 171A and 171B form a V-shape and are also pivotably connected to seat rail 178 (or a joint pivotably connecting seat rail 178 and backrest rail 180). Seat rail 178 can be manufactured from an I-beam with top web tapers from the back to the front so that seat 192 can be positioned at about 10 degrees below the horizontal plane. A bracket (not shown) supports seat 192 at positions from about 10 degrees below the horizontal plane to about 20 degrees above the horizontal. Furthermore, seat rail 178 may include. several holes through both lower webs (not shown) for attaching optional devices, such as hand holds, foot rests, etc. Backrest rail 180 attaches to seat rail 178 at a rotational joint 179. Pneumatic lift 183 attaches to backrest rail 180 and to vertical support cross member 174 using a rotational connection. Pneumatic lift 183 enables backrest 196 to be adjusted from the vertical position to the horizontal position.

Adjustable frame 170 also includes handlebars 184A and 184B that are made of round tubes bent into a circular or other curvature and be can attached to the top and bottom of backrest rail 180. Handlebars 184A and 184B provide a convenient and sturdy surface for the participants to hold onto at about the chest height of the participant. Furthermore, handlebars 184A and 184B may be used for attaching of optional attachments such as a tray to hold a bottle of champagne on ice, or a glass holder.

Seat 192 includes a narrow seat nose 193 and wider seat shoulders 194A and 194B. Seat nose 193 may be shaped for a person facing backrest 196 to easily straddle seat nose 193 while standing or sitting. Seat nose 193 and seat shoulders 194A and 194B may be shaped to provide kneeling cushions for a person kneeling over backrest 145. The seat edges may be slightly concave to provide resistance so that the buttocks of a sitting person will not easily roll off. Seat shoulders 194A and 194B may be shaped to accommodate the knees of a person kneeling and facing backrest 196. The surface of seat 192 or backrest 196 is soft or padded to give comfort to a sitting or kneeling person. The soft layer is supported by a harder substrate. Headrest 200 may also be made of a padded material on a round, oval or rectangular substrate.

Alternatively, the entire seat 192 may be narrow throughout its length so that it can be straddled throughout its length, or may have a shape without seat nose 193. Seat 192 and backrest 196 may be removably positioned on, or attached to, seat rail 178 and backrest rail 180 using various mechanisms known in the art. Seat 192 and backrest 196 may be replaced by other surfaces to provide the user with multiple usages. The apparatus can be easily assembled and disassembled to allow for space saving and storing and portability.

Figure 5A:
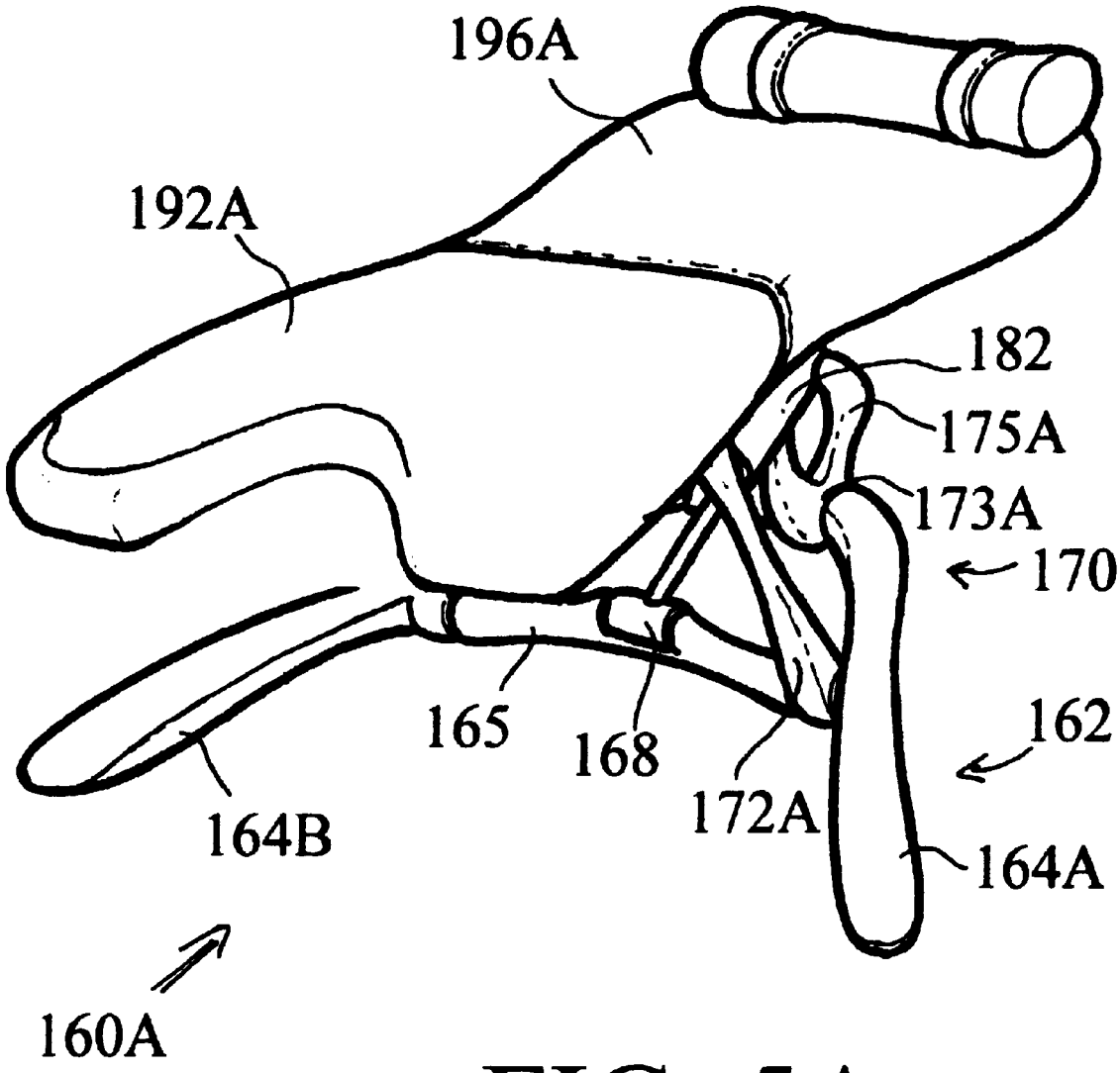
FIGS. 5A, 5B and 5C illustrate alternative embodiments of the apparatus of FIG. 5.
Figure 5B:
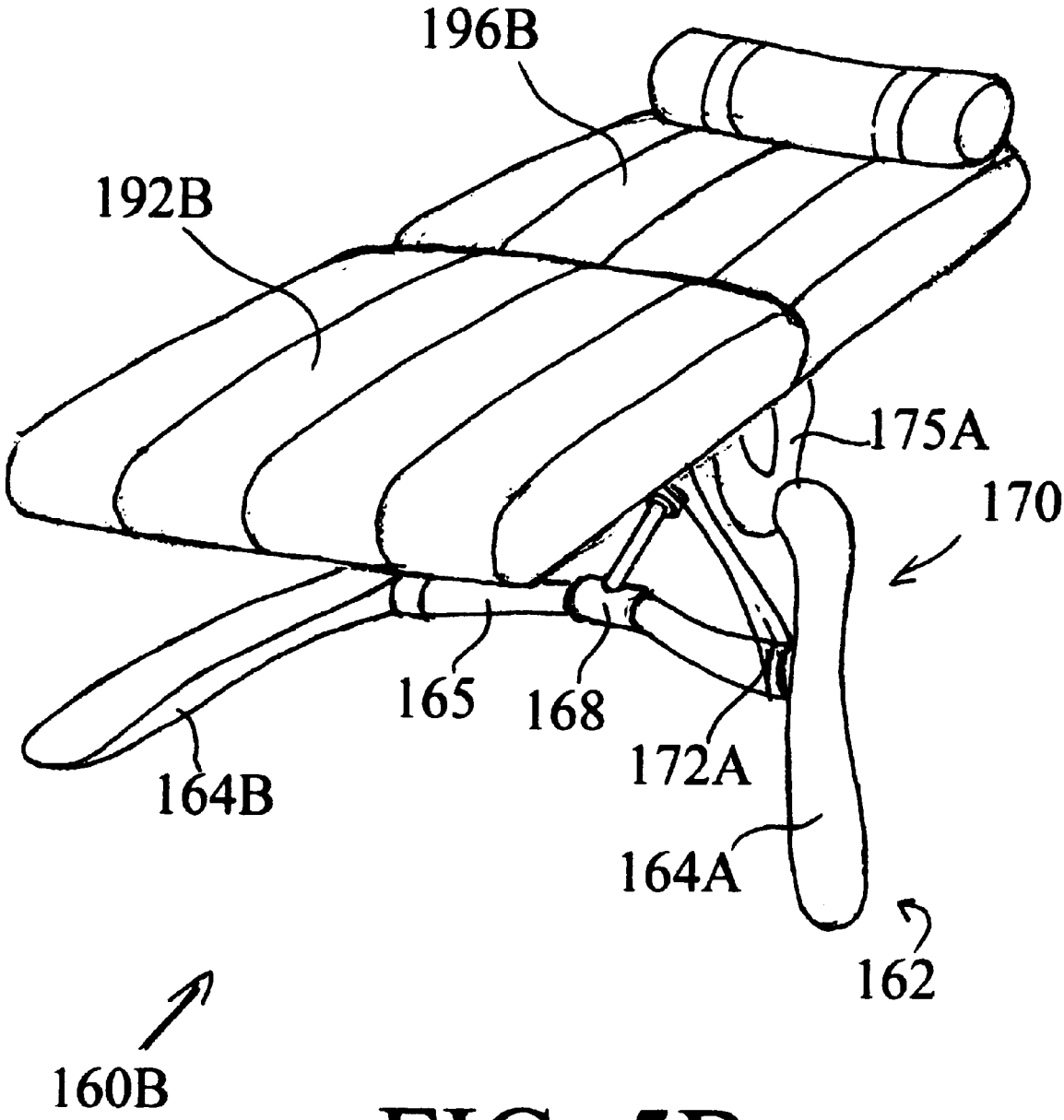
Figure 5C:
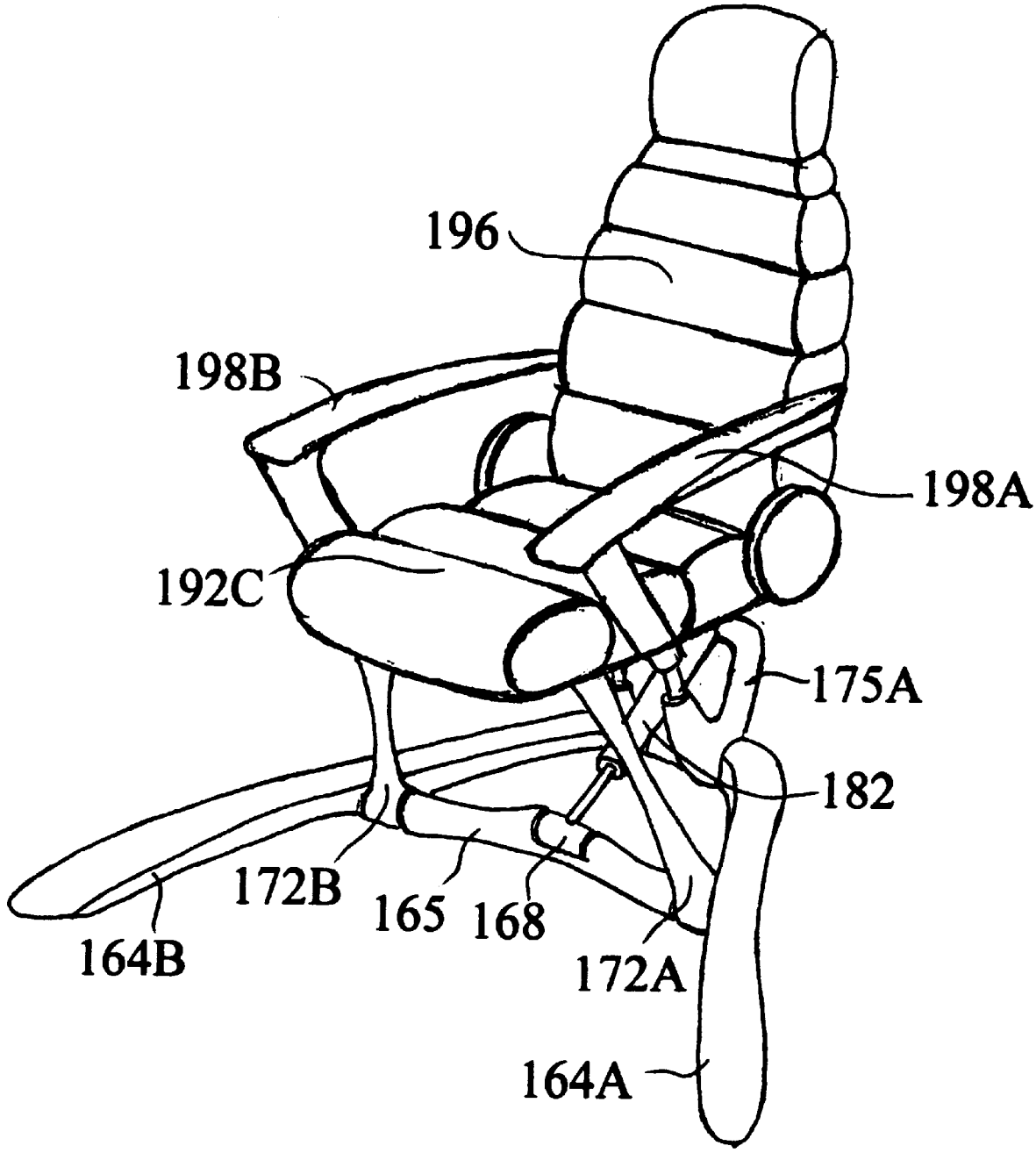

FIGS. 5A, 5B and 5C illustrate alternative embodiments of the apparatus of FIG. 5. In these embodiments, seat 192, backrest 196, and possibly headrest 200 are removed and replaced by other support surfaces. FIG. 5A illustrates a massage table located on frame 170. The massage table includes a lower support surface 192A and an upper support surface 196A removably attached to seat rail 178 and backrest rail 180 (shown in FIG. 5). FIG. 5B illustrates a twin bed with surfaces 192B and 196B, located on frame 170. FIG. 5B illustrates a lounge chair removably attached to frame 170. The lounge chair includes a seat surface 192C supported by seat rail 178, a backrest 196C supported by backrest rail 180, and arm rests 198A and 198B.

Figure 6:
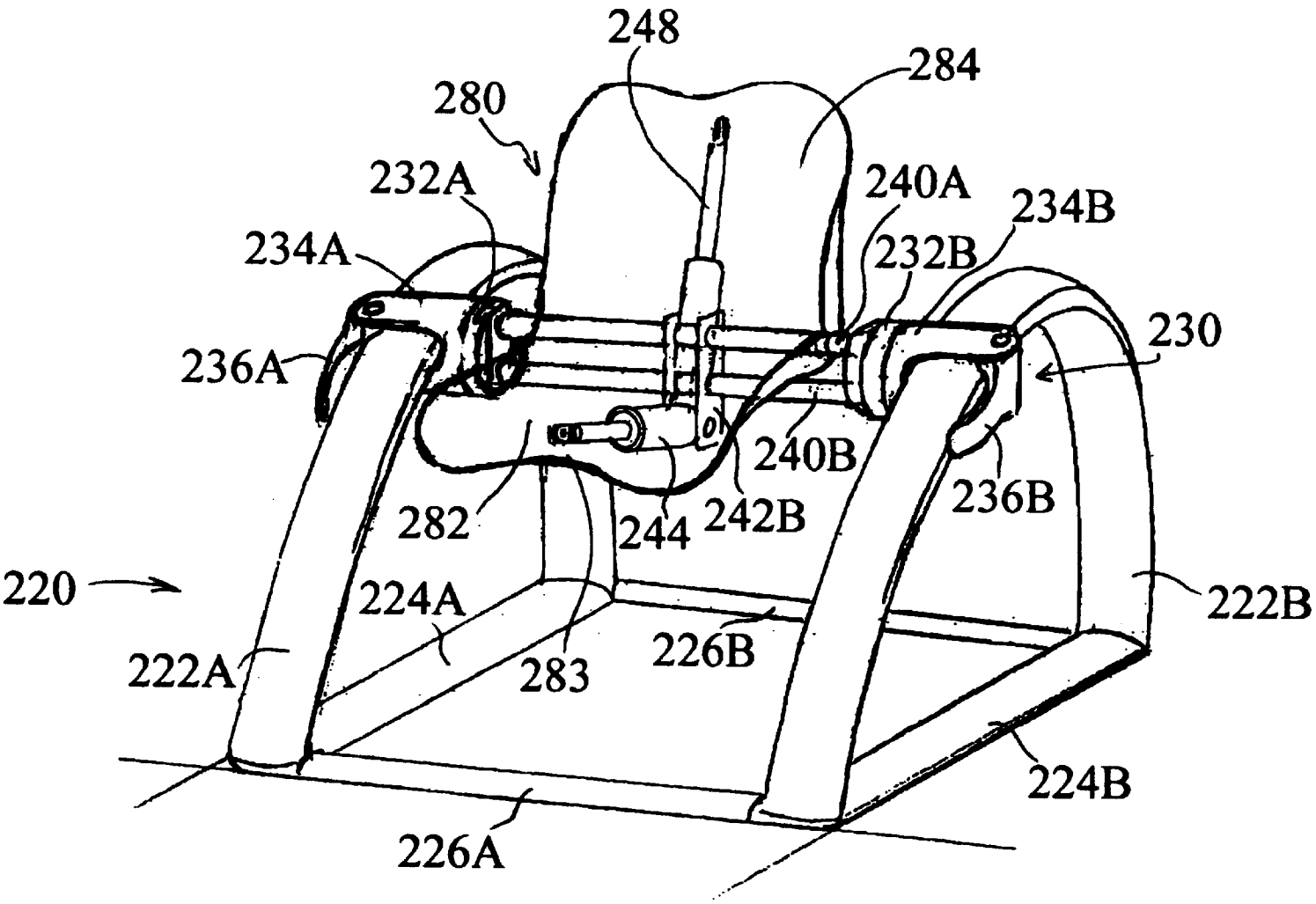
FIG. 6 is a perspective front view of yet another embodiment of an apparatus for supporting a human body during intimate activities.
Figure 6A:
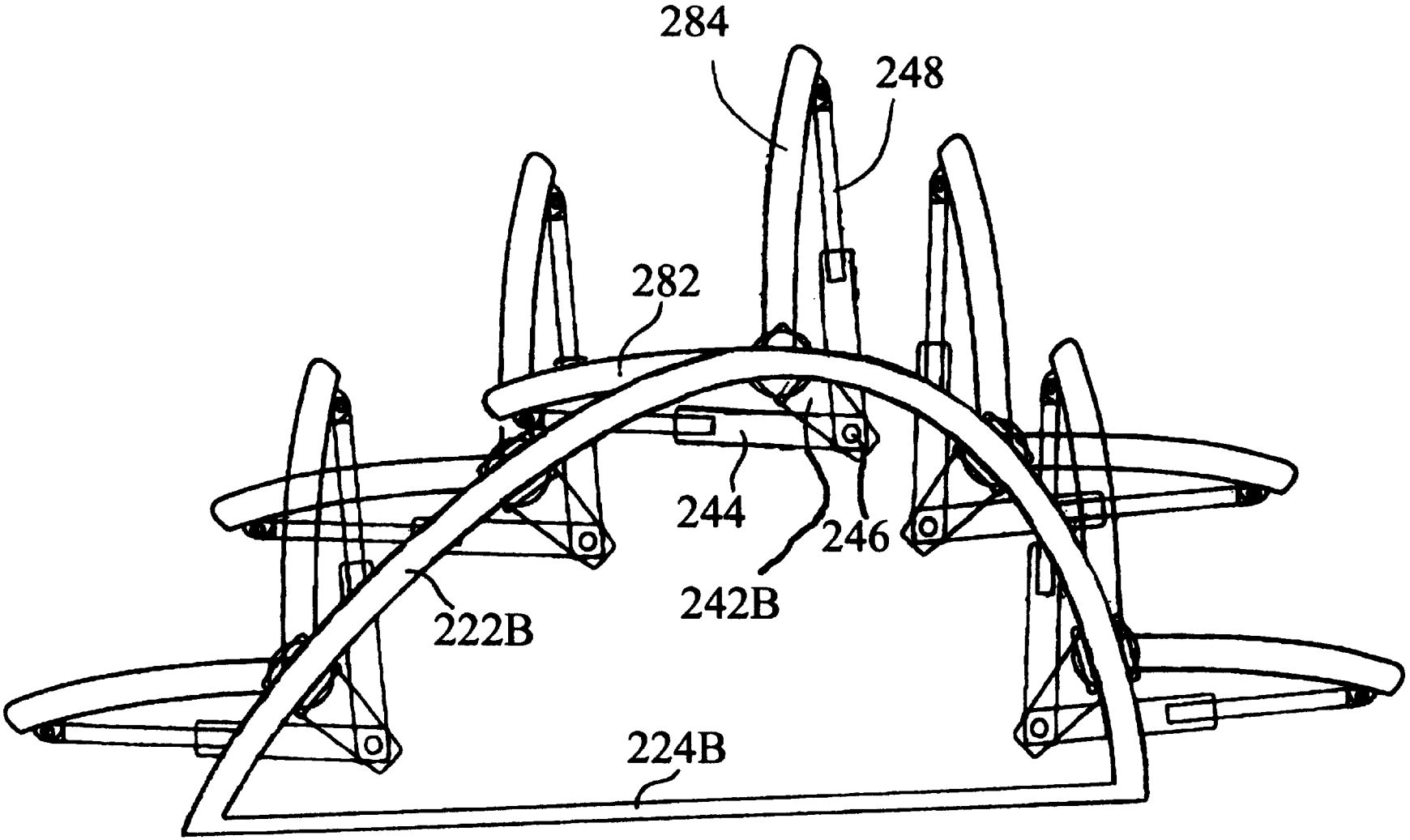
FIG. 6A is a side view of the apparatus of FIG. 6 shown in various positions.
Figure 6B:
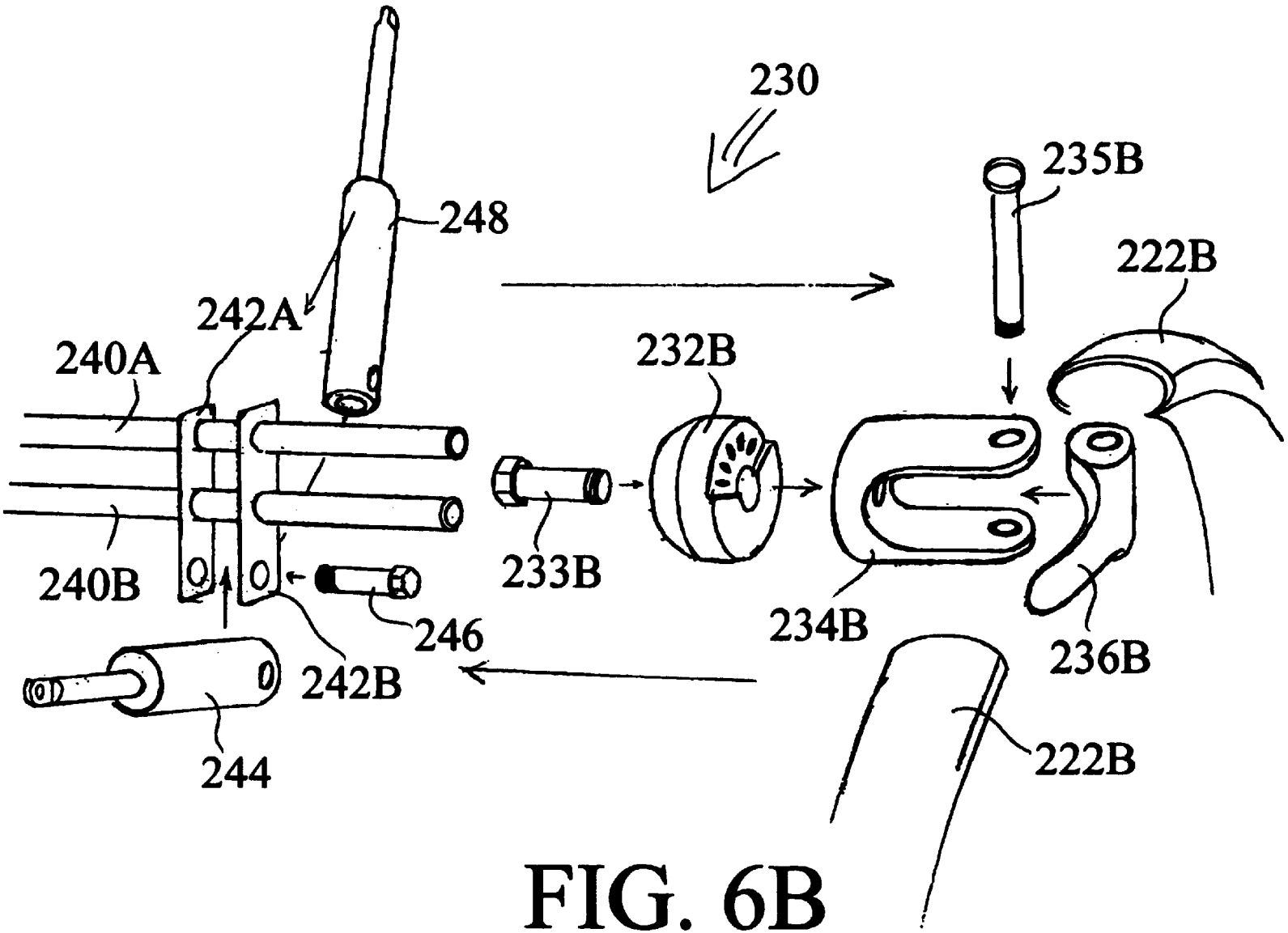
FIG. 6B is an exploded view of a positioning mechanism used in the apparatus of FIG. 6.

FIGS. 6, 6A and 6B show another embodiment of an apparatus for supporting a human body including the human torso, arms or legs during various intimate activities. An apparatus 210 includes a fixed frame (generally shown as 220), an adjustably sliding mechanism (generally shown as 230), and one or several support surfaces (generally shown by arrow 280) for at least partially supporting a human body. Fixed frame 220 includes two D-shaped rails 222A and 222B connected to respective base cross feet 224A and 224B (or another type of a base platform), and side cross feet 226A and 226B. D-shaped rails 222A and 222B are constructed to receive adjustable, sliding mechanism 230. Sliding mechanism 230 includes two cog gear members 232A and 232B, and clamps 234A and 234B, connected to latches 236A and 236B, and cooperatively arranged for movement on D-shaped rails 222A and 222B.

Also referring to FIG. 6B, cog gear members 232A and 232B are connected to two cross bars 240A and 240B constructed and arranged to carry the load of support surface 280 with at least one human. Each cog gear member 232 is connected to bracket 234 by a bolt 233 (only one bolt 233B shown in FIG. 6B). Cross bars 240A and 240B are connected to each cog gear member (232A and 232B) and are arranged to hold support brackets 242A and 242B. Pneumatic lifts (pistons) 244 and 248 are connected to support brackets 242A and 242B by a bolt 246. Pneumatic lifts 244 and 248 enable independent positioning of a seat 282 and a backrest 284, respectively.

Adjustable, sliding mechanism 230 utilizes cog gear members 232A and 232B for rotating bars 240A and 240B. Adjustable, sliding mechanism 230 also utilizes clamps 232A and 232B for moving support surfaces 280 up and down D-shaped rails 222A and 222B, while seat 282 and backrest 284 can remain at a constant angle with respect to the floor by adjusting cog gear members 232A and 232B, as shown in FIG. 6A.

Support cross bars 240A and 240B may be attached to their respective cog gear members 232A and 232B using clamps. The top bar 240A provides a mounting pivot for seat 282 and backrest 284. Advantageously, brackets 242A and 242B hold bars 240A and 240B in position and enable pivotable mounting of pneumatic lifts 244 and 248. Pneumatic lifts 244 and 248 are in turn attached to seat 282 and backrest 284. Pneumatic lifts 244 and 248 enable a user to position independently seat 282 from backrest 284 at about 90 degrees to each other or any other angle in between about 80 degrees and about 200 degrees, and preferably between about 90 degrees and about 180 degrees.

Adjustably sliding mechanism 230 may also be adjusted remotely by actuation of motors or hydraulics, or may be spring loaded to assist the user in adjusting the position of seat 282 and backrest 284, especially in a weight bearing condition. Adjustably sliding mechanism 230 may also be controlled by a computer so that the movement is performed under computer control or in accordance with a pre-programmed routine.

Apparatus 210 may be constructed as a foldout part of furniture such as a couch, a closet, a bed or an armoire. Fixed frame 220 may be disassembled or folded by separating D-shaped rails 222A and 222B from the respective base cross feet 224A and 224B and from side cross feet 226A and 226B.

Apparatus 210 may include different support surfaces 280. As shown in FIG. 6, seat 282 may include a seat cutout 283. Alternatively, seat 282 and backrest 284 may have the shape of seat 50 and backrest 52. Alternatively, apparatus 210 may include a table surface, which can be positioned along D-shaped rails 222A and 222B to any desired height, and can be further adjusted to any desired angle. Apparatus 210 may also include a lounge chair and thus provide support for a person's entire body instead of just a person's torso.

A large variety of accessories may be incorporated within the apparatus. One or more cushions may be disposed at various locations along the apparatus. Other accessories may include grab bars, stirrups, a variety of mounts for different devices.

Figure 7:
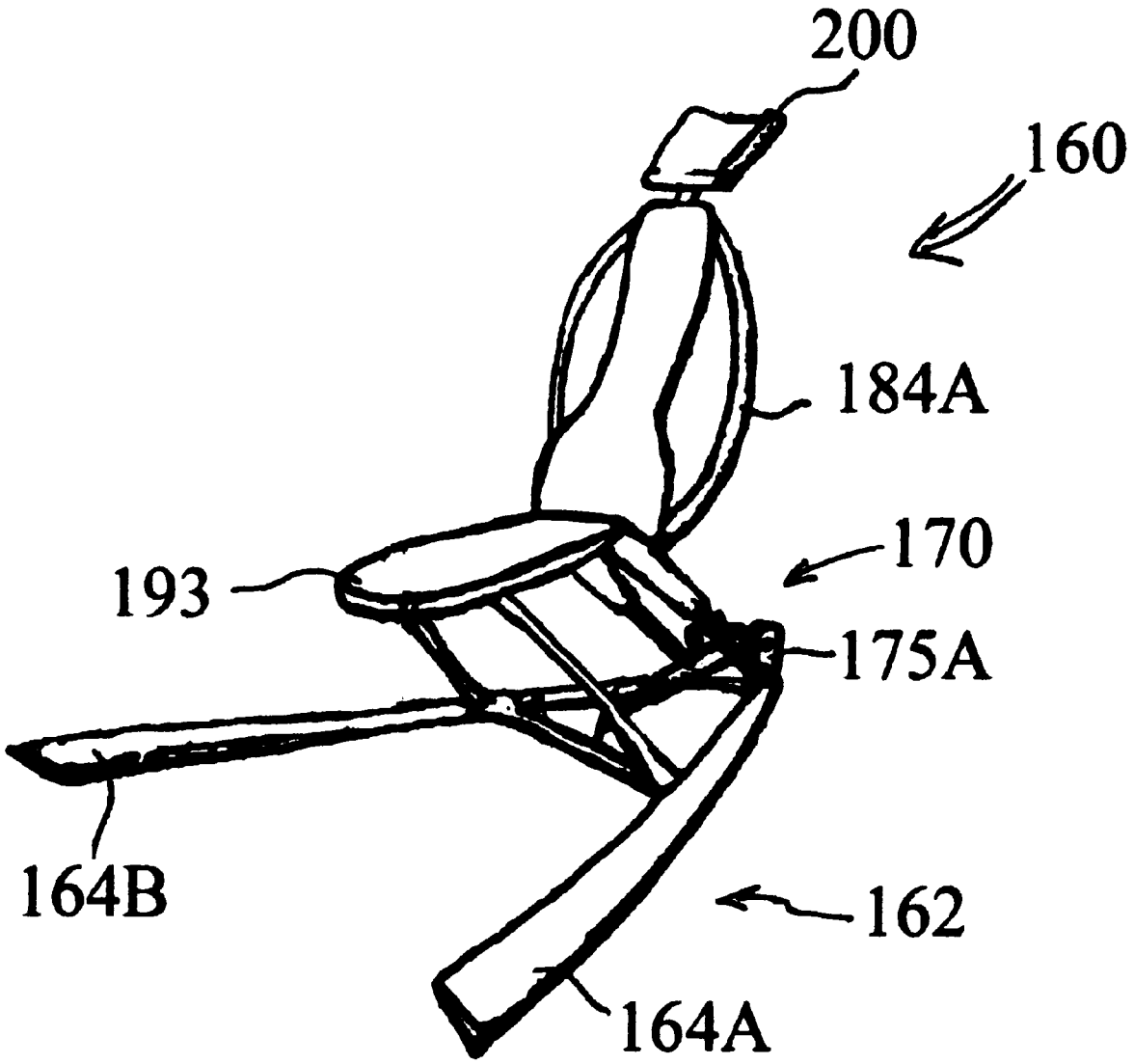
FIGS. 7 and 7A illustrate a couple utilizing the apparatus for supporting a human body during their intimate activity.
Figure 7A:
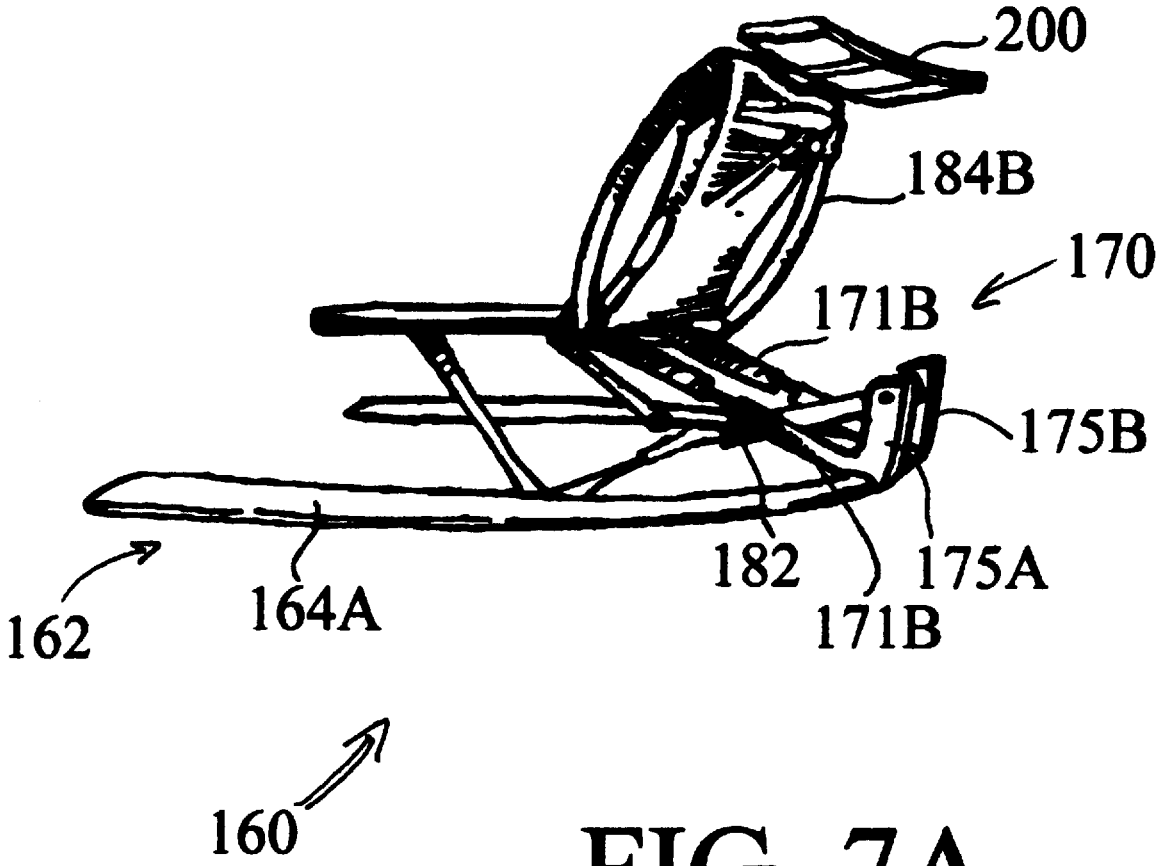

FIGS. 7 and 7A illustrate a couple utilizing the apparatus of FIG. 5 during their intimate activity. The couple can, of course, use any one of the above-described apparatuses for supporting at least one human body during intimate activities. When using the above apparatuses, a couple can achieve many different positions by adjusting the seat angle and height, by using the backrest at different angles, or removing it and replacing it with an elbow support or another surface. Thus, the couple can assume various positions for sexual intercourse or other intimate activities.

The adjustable frame can be raised or lowered vertically to an elevation which provides best height for the standing, kneeling or sitting men or women of various heights. Furthermore, the seat and the backrest can be separately tilted on a pivot to an angle which places one partner of the couple in alignment with the other partner during their intimate activities. The adjustable frame and the individual elements can be locked into place to achieve different stable positions.

The above-described embodiments are example of the present invention. It should be clear to those skilled in the art that various modifications, additions and subtractions can be made without departing from the spirit or scope of the invention defined by the enclosed claims. Additional embodiments are within the following claims:

What is claimed is:

1. An apparatus for at least partially supporting a human body of at least a first human during an intimate activity of two humans, comprising: a base coupled to a frame connectable to a first support surface constructed to be adjusted to a first selected position, and at least one handle constructed and positioned for holding by said second human, wherein said first support surface includes a narrow front portion and a wide rear portion and wherein said narrow front portion of said first support surface is about 2 inches to about 20 inches wide.

2. The apparatus of claim 1 wherein said first support surface includes a seat.

3. The apparatus of claim 1 wherein said first selected position includes a selected height of said first surface above a floor surface.

4. The apparatus of claim 1 wherein said first selected position includes a selected angle of said first surface relative to a horizontal surface.

5. The apparatus of claim 1 further including a second support surface constructed to be adjusted independently of said first support surface and constructed to be located at a second selected position.

6. The apparatus of claim 1, wherein at least one of said lifts is a pneumatic lift.

7. The apparatus of claim 1, wherein at least one of said lifts is a hydraulic lift.

8. The apparatus of claim 1, wherein said frame is connectable to said first support surface using a bolt.

9. An apparatus for at least partially supporting a human body of at least a first human during an intimate activity of two humans, comprising a base coupled to a frame, a first support surface constructed to be adjusted to a first selected position, said frame including two lifts constructed and arranged to change a height of said first support surface, and at least one handle constructed and positioned for holding by a second human, and a second support surface constructed to be adjusted independently of said first support surface and constructed to be located at a second selected position, wherein said frame further includes a second rail connectable to a main rail and arranged to bear weight of said second support surface, said second rail being independently positionable relative to said main rail and being constructed to displace said second surface to said second selected position.

10. The apparatus of claim 9 wherein said second selected position includes a selected height of said second surface above a floor surface.

11. The apparatus of claim 9 wherein said second selected position includes a selected angle of said second surface relative to a horizontal surface.

12. The apparatus of claim 9 wherein said second support surface includes a backrest.

13. The apparatus of claim 9 wherein said second support surface is constructed and shaped for resting elbows.

14. The apparatus of claim 9 further including a third support surface constructed to be adjusted independently of said first and second support surfaces and be located at a third selected position.

15. The apparatus of claim 14 wherein said third support surface includes a headrest.

16. The apparatus of claim 14 wherein said third support surface includes an elbow and forearm rest.

17. The apparatus of claim 9, wherein at least one of said lifts is a pneumatic lift.

18. The apparatus of claim 9, wherein at least one of said lifts is a hydraulic lift.

19. An apparatus for at least partially supporting a human body of at least a first human during an intimate activity of two humans, comprising a base coupled to a frame, a first support surface constructed to be adjusted to a first selected position, said frame including two lifts constructed and arranged to change a height of said first support surface, and at least one handle constructed and positioned for holding by said second human, and a second support surface constructed to be adjusted independently of said first support surface and constructed to be located at a second selected position, a third support surface constructed to be adjusted independently of said first and second support surfaces and be located at a third selected position, wherein said frame further includes a third rail connectable to a main rail and arranged to bear weight of said third support surface, said third rail being independently positionable relative to first and second rails and being constructed to position said third support surface to said third selected position.

20. An apparatus for at least partially supporting a human body of at least a first human during an intimate activity of two humans, comprising a base coupled to a frame, a first support surface constructed to be adjusted to a first selected position, said frame including two lifts constructed and arranged to change a height of said first support surface, and at least one handle constructed and positioned for holding by said second human, wherein said handle includes a bar being connected to said frame and having a holding surface at a height of about 2 to about 10 inches above said first surface.

21. The apparatus of claim 20, wherein at least one of said lifts is a pneumatic lift.

22. The apparatus of claim 20, wherein at least one of said lifts is a hydraulic lift.

23. The apparatus of claim 22 wherein said front and rear slider legs include an adjustable mechanism that includes one of the following: a pneumatic lift, a hydraulic lift, a lever, and a tension device.

24. The apparatus of claim 20, wherein said bar has semi-circular shape.

25. The apparatus of claim 20, wherein said first support surface includes a seat.

26. The apparatus of claim 20, wherein said first support surface includes a narrow front portion and a wide rear portion.

27. The apparatus of claim 20, wherein said first selected position includes a selected angle of said first surface relative to a horizontal surface.

28. The apparatus of claim 20 further including a second support surface constructed to be adjusted independently of said first support surface and constructed to be located at a second selected position.

29. An apparatus for at least partially supporting a human body during an intimate activity, comprising a base coupled to an adjustable frame constructed to bear weight of two support surfaces, said two support surfaces being independently removable from said frame and being independently adjustable to assume first and second selected positions, wherein said two support surfaces are located next to each other and their height is adjustable to change relative orientation of said two support surfaces arranged to receive in contact and support large area body parts.

30. The apparatus of claim 29, wherein said frame is constructed to receive, after removing said two support surfaces, one of the following: a table surface, a chair surface, a sleeping surface, a massage surface, and a table surface.

31. An apparatus for at least partially supporting a human body during an intimate activity, comprising a plate-shaped base means for providing stability coupled to a frame means for supporting two support surface means, said two support surface means being independently removable from said frame means and being independently adjustable to assume a number of selected positions and a handle bar being connected to said frame means and including a holding surface at a height of about 2 to about 10 inches above one of said surface means.

32. A method of performing an intimate activity by two humans using an apparatus for at least partially supporting a body of at least one human comprising:

providing an apparatus for at least partially supporting a human body, comprising a base coupled to a frame connectable to a first support surface;

adjusting said first support surface to a first selected position by using two lifts arranged to change a height of said support surface;

supporting at least partially said body of a first human on said adjusted first support surface; and performing an intimate activity by said two humans.

33. The method of claim 32 further including:

providing a second surface constructed to be adjusted independently of said first surface of said apparatus;

adjusting said second support surface to a second selected position prior to said supporting of said first human on said first support surface; and supporting at least partially said body of said first human by said adjusted second support surface prior to performing said intimate activity.

34. An apparatus for at least partially supporting a human body of at least a first human during an intimate activity of two humans, comprising a base coupled to a frame connectable to a first support surface constructed to be adjusted to a first selected position, and at least one handle constructed and positioned for holding by said second human, wherein said first support surface includes a narrow front portion and a wide rear portion and a second support surface constructed to be adjusted independently of said first support surface and constructed to be located at a second selected position.

35. The apparatus of claim 34 wherein said frame further includes a second rail connectable to a main rail and arranged to bear weight of said second support surface, said second rail being independently positionable relative to said main rail and being constructed to displace said second surface to said second selected position.

36. The apparatus of claim 34 wherein said second selected position includes a selected height of said second surface above a floor surface.

37. The apparatus of claim 34 wherein said frame is connectable to said first support surface using front and rear slider legs.

* * * * *